US007629104B2

(12) United States Patent
Tanaka et al.

(10) Patent No.: US 7,629,104 B2
(45) Date of Patent: Dec. 8, 2009

(54) CARRIER, METHOD FOR PRODUCING THE CARRIER, DEVELOPER, AND IMAGE FORMING METHOD USING THE DEVELOPER

(75) Inventors: Chiaki Tanaka, Izunokuni (JP); Masayuki Ishii, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 466 days.

(21) Appl. No.: 11/498,787

(22) Filed: Aug. 4, 2006

(65) Prior Publication Data

US 2007/0031750 A1 Feb. 8, 2007

(30) Foreign Application Priority Data

Aug. 8, 2005 (JP) ..... 2005-229574

(51) Int. Cl.
*G03G 9/113* (2006.01)

(52) U.S. Cl. ..... 430/137.13

(58) Field of Classification Search ..... 430/137.13
See application file for complete search history.

(56) References Cited

U.S. PATENT DOCUMENTS

| | | | | |
|---|---|---|---|---|
| 4,584,254 | A * | 4/1986 | Nakayama et al. | 430/111.1 |
| 5,514,512 | A * | 5/1996 | Cunningham et al. | 430/137.13 |
| 5,725,987 | A | 3/1998 | Combes et al. | |
| 6,426,116 | B1 | 7/2002 | Sunol | |

FOREIGN PATENT DOCUMENTS

| | | | |
|---|---|---|---|
| EP | 0 990 954 | A1 | 4/2000 |
| EP | 1 260 874 | A1 | 11/2002 |
| JP | 55-127569 | | 10/1980 |
| JP | 55-157751 | | 12/1980 |
| JP | 56-140358 | | 11/1981 |
| JP | 57-96355 | | 6/1982 |
| JP | 57-96356 | | 6/1982 |
| JP | 58-207054 | | 12/1983 |
| JP | 61-110161 | | 5/1986 |
| JP | 62-273576 | | 11/1987 |
| JP | 2006-77219 | | 3/2006 |
| JP | 2006-78895 | | 3/2006 |
| JP | 2006106208 | * | 4/2006 |

OTHER PUBLICATIONS

JP 2006106208 Abstract, Apr. 2006.*
JP 2006106208 English language machine translation, Apr. 2006.*
U.S. Appl. No. 11/752,343, filed May 23, 2007, Nagatomo, et al.
U.S. Appl. No. 11/522,936, filed Sep. 19, 2006, Ishii, et al.
U.S. Appl. No. 11/853,520, filed Sep. 11, 2007, Inoue, et al.
U.S. Appl. No. 11/676,883, filed Feb. 20, 2007, Tanaka.
U.S. Appl. No. 12/264,643, filed Nov. 4, 2008, Yoshida, et al.

* cited by examiner

*Primary Examiner*—Hoa V Le
(74) *Attorney, Agent, or Firm*—Oblon, Spivak, McClelland, Maier & Neustadt, L.L.P.

(57) ABSTRACT

The present invention provides a method for producing a carrier which includes forming a coating layer on a surface of a core material by dissolving or dispersing at least a coating resin in a supercritical or subcritical fluid, and a carrier produced by the method for producing a carrier.

11 Claims, 15 Drawing Sheets

CARRIER, METHOD FOR PRODUCING THE CARRIER, DEVELOPER, AND IMAGE FORMING METHOD USING THE DEVELOPER

BACKGROUND OF THE INVENTION

1. Field of the Invention

The present invention relates to a carrier preferably used for electrophotography (xerography), electrostatic recording method, electrostatic printing method, and the like and also relates to a method for producing the carrier, a developer and an image forming method using the developer.

2. Description of the Related Art

Dry developing method used for electrophotography is a method in which a toner frictioned with a charting unit is made to electrostatically adhere on a latent electrostatic image to form a visible image.

The dry developing method is divided into a so-called one-component developing process using primarily a toner, and a so-called two-component developing process using glass beads, and a magnetic carrier, or using a mixture of a coat carrier with the surface thereof coated with a resin, and a toner.

A developer used for a two-component developing process is held by electric force generated from friction between microscopic toner particles on the surface of relatively large core material, and when the developer is made to closely contact with a latent electrostatic image, the electric field formed by the latent electrostatic image makes the toner particles superior to the binding force between the core material and the toner particles to thereby develop the toner on the latent electrostatic image. Then, the developer is repeatedly used while replacing a toner that has been consumed in developing.

For the reason, during the use of a toner for long hours, the toner material must be frictionally charged with a polarity constantly requesting toner particles and a sufficient charge amount. However, inter-particle collision, mechanical agitation of particles in a developing unit, and/or heat generated therefrom make a toner fused on the core material surface, in other words, a so-called spent toner is caused on a core material surface, and the charge property of the core material is degraded with use time. As the result, background smear of image and toner scattering are caused, and thus it gives rise to a need to replace the developer entirely.

To prevent occurrences of such a toner spent, it is tried to make a carrier have a longer operating life by coating a surface of a core material with a resin having low surface energy, for example, a fluorine resin, a silicone resin, etc. For example, there are the following carriers. A carrier coated with a room temperature curable silicone resin and a positively charged nitrogen resin (Japanese Patent Application Laid Open (JP-A) No. 55-127569); a carrier coated with a coating material containing at least one modified silicone resin (Japanese Patent Application Laid Open (JP-A) No. 55-157751); a carrier having a coating layer containing a room temperature curable silicone resin and a styrene-acrylic resin (Japanese Patent Application Laid Open (JP-A) No. 56-140358); a carrier of which surfaces of nucleic particles are coated with two or more layers of silicone resins so as not to have adhesiveness between the layers (Japanese Patent Application Laid Open (JP-A) No. 57-96355); a carrier of which nucleic particle surfaces are coated with silicone resins in a multi-layered structure (Japanese Patent Application Laid Open (JP-A) No. 57-96356); a carrier of which carrier particle surfaces are coated with a silicone resin containing a silicon carbide (Japanese Patent Application Laid Open (JP-A) No. 58-207054); a positively charged carrier coated with a material exhibiting a critical surface tension of 20 dyn/cm or less (Japanese Patent Application Laid Open (JP-A) No. 61-110161); and a developer which contains a carrier coated with a coating material containing fluoroalkyl acrylate, and a toner containing a chrome azo dye (Japanese Patent Application Laid Open (JP-A) No. 62-273576).

In recent years, to obtain higher image quality, toner size tends to be made into smaller particle diameters, and as the result, a toner spent to a carrier in a two-component developer easily occurs. In addition, with a conventional spray coating, it is difficult to get the carrier surface uniformly wet with a coating material, and therefore it has become difficult to produce a carrier having appropriate adhesiveness between the coated film and the core material and uniform thickness and film quality. Further, in the case of a full-color toner, a low-softening point resin is used to obtain sufficient color tone, and therefore the full-color toner causes much more amount of toner spent to a carrier than in the use of a black toner, and this leads to reduction in charge amount of toner and also leads to toner scattering, and background smear. In a full-color electrophotographic system, when the charge amount of toner is reduced, the image density easily changes particularly at highlighted portions to make it unable to keep high-image quality.

Since there are microscopic concaves and convexes or irregularities on a carrier particle surface, the coated layer is thickened in concave portions, and convex portions have a thin coat layer or are not coated sufficiently, it may be difficult to make a coating layer into a dense, well-adhesive and uniformly formed thin layer and to coat a core material with such a thin layer. As the result, with the use of a conventional carrier, the toner charge ability and the temporal stability are poor, and this causes various problems such as background smear and abnormal image as well as toner spent to the carrier.

In addition, there are problems in manufacturing process such as restrictions of volatile organic compounds (VOC) generated from organic solvents used in forming a coating layer on the core material surface, occurrences of waste fluid, and a further necessity of dry energy. The conventional methods for producing a carrier and conventional carriers have may problems to solve, from the viewpoint of high-cost performance, global environmental burden, and natural resource saving.

SUMMARY OF THE INVENTION

It is therefore an object of the present invention to provide a method for producing a carrier which enables excellent toner charge ability, and temporal stability, low-cost production without substantially causing waste fluid and without necessity of dry process, and have the least environmental burden by forming a coating layer on a core material surface in a supercritical or subcritical fluid. The present invention also provides a carrier which has a coating layer having excellent adhesiveness and a uniform thickness, which is produced by the method for producing a carrier, a developer using the carrier, and an image forming method.

In view of the above-mentioned problems, the inventors of the present invention have investigated vigorously, and have obtained the following findings. Specifically, the present inventors found that by using a supercritical or subcritical fluid as a solvent instead of a conventional organic solvent, the interfacial tension closes in zero in such a supercritical fluid, and thus even with a core material surface having microscopic irregularities, it is possible to get a core material surface wet with a coating solution as well as to obtain a carrier which has excellent adhesiveness between the core material and a coating layer, allows forming a coating layer having a uniform thickness, has high-mechanical strength, and excels in toner charge ability and temporal stability. In addition, the method for producing a carrier of the present invention enables efficiently producing a carrier, clearing the restrictions of volatile organic compound (VOC) without generating waste fluids and without necessity of a substantial amount of dry energy. The present inventors also found that a supercritical carbon dioxide has excellent properties, namely, is nonflammable and has high safety and allows obtaining a carrier having a hydrophobic surface using a nonaqueous solvent, and is gasified by just only restoring the pressure to normal pressure, and thus the collection and recycling can be easily performed, and the obtained carrier has excellent property that it needs no dry treatment.

A first aspect of the method for producing a carrier of the present invention is that at least a coating resin is dissolved or dispersed in a supercritical or subcritical fluid to thereby form a coating layer on the core material surface.

A second aspect of the method for producing a carrier of the present invention is that a solution with at least a coating resin dissolved or dispersed therein is sprayed over a core material surface in a supercritical or subcritical fluid to thereby form a coating layer on the core material surface.

A third aspect of the method for producing a carrier of the present invention is that a solution in which at least a core material and a coating resin are contained and the coating resin is dissolved or dispersed, is pressurized and released in a supercritical or subcritical fluid and then rapidly expanded to thereby form a coating layer on the core material surface.

A fourth aspect of the method for producing a carrier of the present invention is that the solubility of a solution in which at least a core material and a coating resin are contained and the coating resin is dissolved or dispersed, is reduced by controlling at least any one of pressure and temperature in a supercritical or subcritical fluid to thereby form a coating layer on the core material surface.

In the methods for producing a carrier relating to the first aspect to the fourth aspect, it is possible to produce a carrier having excellent adhesiveness between a core material and a coating layer and a uniform thin layer, to make restrictions of volatile organic compounds (VOC) cleared, as well as to efficiently produce such a carrier without causing waste fluids and without necessity of substantial dry energy.

According to the first aspect of the present invention, the carrier has a coating layer which is formed on the core material surface in at least one of a supercritical fluid or a subcritical fluid.

When cross-sectional scanning electron microscopic photographs of arbitrarily chosen 10 carrier particles of the carrier are taken at a magnification of 2,000-times using a scanning electron microscope, and eight radiation lines are drawn on the respective photographs in eight directions respectively angled at 45 degrees centering around the median point of the each core material cross-sectional surface, and the standard deviation of the thickness of the coating layer at 80 sites in total measured at eight intersection points with the core material surface is 0.1 or less.

According to the second aspect of the present invention, the carrier is produced by any one of the methods for producing a carrier of the first aspect to the fourth aspect of the present invention.

The carriers relating to the first aspect and the second aspect of the present invention respectively have excellent adhesiveness between a core material and a coating layer, allow forming a uniform coating layer, and have high-mechanical strength, and a developer using the carrier is excellent in charge ability and temporal stability.

The developer of the present invention contains any one of carriers of the first aspect and the second aspect, and a toner.

The image forming method of the present invention includes at least forming a latent electrostatic image on a latent electrostatic image bearing member, developing the latent electrostatic image using the developer of the present invention to form a visible image, transferring the visible image onto a recording medium, and fixing the transferred image on the recording medium. In the image forming method of the present invention, a latent electrostatic image is formed on a latent electrostatic image bearing member in the latent electrostatic image forming step. The latent electrostatic image is developed using the developer of the present invention to form a visible image in the developing step. The visible image is transferred onto a recording medium in the transferring step. The transferred image is fixed on the recording medium in the fixing step.

DESCRIPTION OF THE PREFERRED EMBODIMENTS

Figure 1:
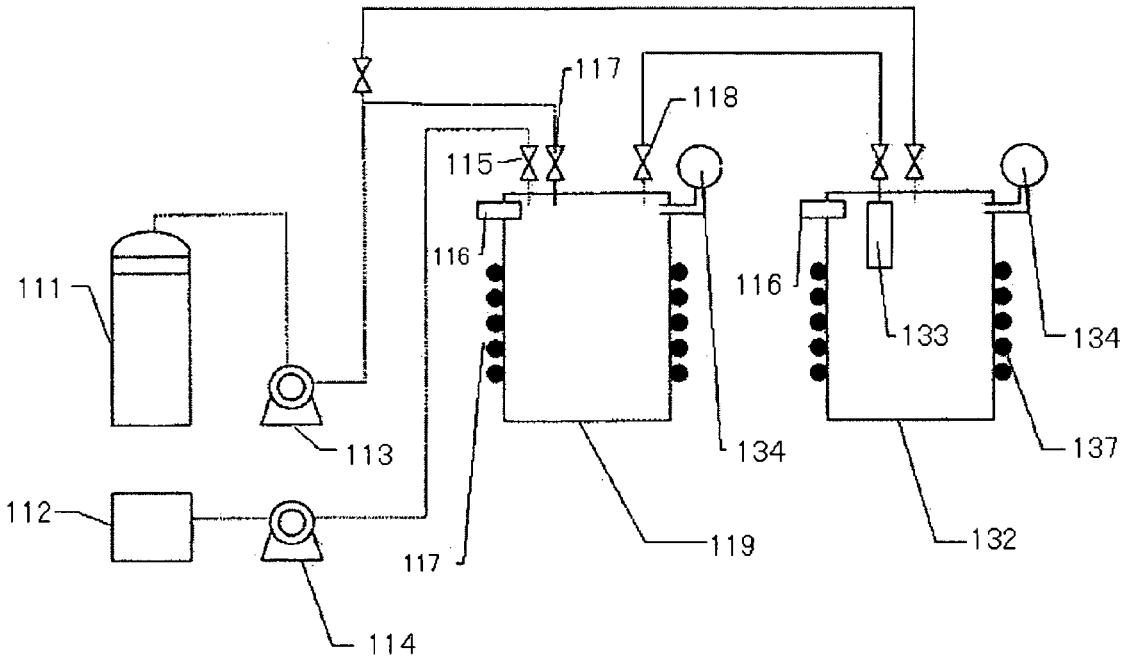
FIG. 1 is a schematic view showing one example of an apparatus used in the method for producing a carrier of the present invention.

Carrier and Method for Producing a Carrier

A first aspect of the method for producing a carrier of the present invention includes a step of forming a coating layer on a core material surface by dissolving or dispersing at least a coating resin in a supercritical or subcritical fluid and further includes other steps in accordance with the necessity.

A second aspect of the method for producing a carrier of the present invention includes a step of forming a coating layer on a core material surface by spraying the core material surface with a solution with at least a coating resin dissolved or dispersed therein in a supercritical or subcritical fluid and further includes other steps in accordance with the necessity.

A third aspect of the method for producing a carrier of the present invention includes a step of forming a coating layer on a core material surface by pressurizing and releasing a solution in which at least a core material and a coating resin are contained and the coating resin is dissolved or dispersed, in a supercritical or subcritical fluid and rapidly expanding the solution and further includes other steps in accordance with the necessity.

A fourth aspect of the method for producing a carrier of the present invention includes a step of forming a coating layer on a core material surface by reducing the solubility of a solution in which at least a core material and a coating resin are contained and the coating resin is dissolved or dispersed, in a supercritical or subcritical fluid by controlling at least any one of pressure and temperature and further includes other steps in accordance with the necessity.

A first aspect of a carrier of the present invention has a coating layer which is formed on the core material surface in at least one of a supercritical fluid or a subcritical fluid, and when cross-sectional scanning electron microscopic photographs of arbitrarily chosen 10 carrier particles of the carrier are taken at a magnification of 2,000-times using a scanning electron microscope, and eight radiation lines are drawn on the respective photographs in eight directions respectively angled at 45 degrees centering around the median point of the each core material cross-sectional surface, and the standard deviation of the thickness of the coating layer at 80 sites in total measured at eight intersection points with the core material surface is 0.1 or less.

According to a second aspect of a carrier of the present invention, the carrier is produced by any one of the methods for producing a carrier of the first aspect to the fourth aspect.

For the first aspect of the carrier of the present invention, when cross-sectional scanning electron microscopic photographs of arbitrarily chosen 10 carrier particles of the carrier are taken at a magnification of 2,000-times using a scanning electron microscope, and eight radiation lines are drawn on the respective photographs in eight directions respectively angled at 45 degrees centering around the median point of the each core material cross-sectional surface, and the standard deviation of the thickness of the coating layer at 80 sites in total measured at eight intersection points with the core material surface is 0.1 or less, preferably 0.07 or less, and still more preferably 0.05 or less. When the standard deviation of the thickness thereof is more than 0.1, carrier properties are easily uneven, the charge rise of the toner is poor, and this contributes to defective charge of the toner, and degradations of environmental stability resulting from temperature and humidity and degradations of image quality.

The thickness of the coating layer can be determined, for example, by the following procedure. On scanning electron microscopic photographs of each cross-sectional surface of 10 carrier particle of the carrier taken using a scanning electron microscope, eight radiation lines are drawn on the respective photographs in eight directions respectively angled at 45 degrees centering around the median point of the each cross-sectional surface of the carrier particles, and then the thickness of the coating layer at eight sites i.e. 80 sites in total are measured at eight intersection points with the each of the carrier particle surface, and then the average value is calculated to thereby determine the thickness of the coating layer.

Figure 18:
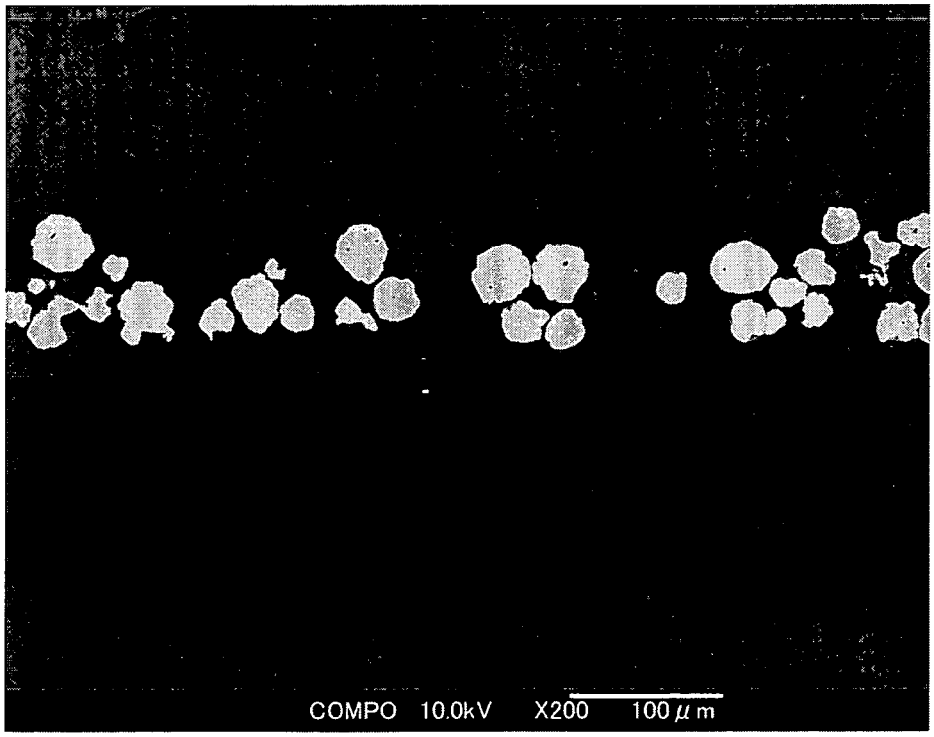
FIG. 18 is a cross-sectional scanning electron microscopic photograph of the carrier used for measuring the thickness of the coating layer of the carrier.
Figure 19:
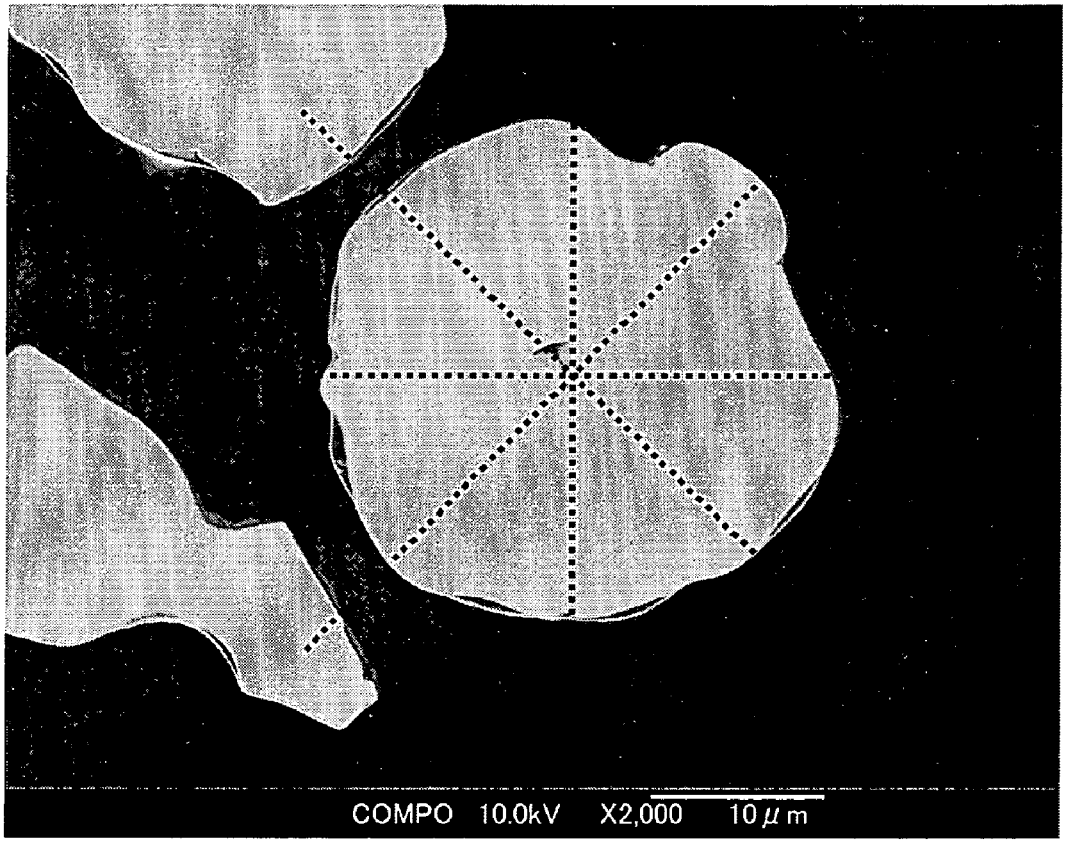
FIG. 19 is a cross-sectional scanning electron microscopic photograph of the carrier showing the measuring method of the thickness of the coating layer of the carrier.

Specifically, as shown in FIG. 18, photographs of the cross-sectional surface of the carrier are taken at a magnification of 2,000-times using a scanning electron microscope. From the obtained scanning electron microscopic photographs of cross-sectional surfaces of the carrier, 10 pieces of carrier particles are arbitrarily selected. Then, as shown in FIG. 19, eight radiation lines are drawn on the respective photographs in eight directions respectively angled at 45 degrees centering around the median point of the each cross-sectional surface of the carrier particles, and then the thickness of the coating layer is measured at eight sites on each of the 10 pieces of carrier particles at eight intersection points with the each of the carrier particle surfaces, and the average value is taken as the thickness of the coating layer.

For scanning electron microscopic photographs of each cross-sectional surface of 10 carrier particles of the carrier taken at a magnification of 2,000-times using a scanning electron microscope, when eight radiation lines are drawn on the respective photographs in eight directions respectively angled at 45 degrees centering around the median point of the each cross-sectional surface of the carrier particles, and then the thickness of the coating layer at eight sites i.e. 80 sites in total are measured at eight intersection points with the each of the carrier particle surfaces, and the average thickness of the coating layers of 80 sites is defined as "d", it is preferable that in respective coating layers of the cross-sectional surfaces of these carrier particles, the number of sites having a coating layer thickness being $\frac{1}{10}d$ or less is four sites or less in the each of the carrier particles.

In addition, for scanning electron microscopic photographs of each cross-sectional surface of 10 carrier particles of the carrier taken at a magnification of 2,000-times using a scanning electron microscope, when eight radiation lines are drawn on the respective photographs eight directions respectively angled at 45 degrees centering around the median point of the each cross-sectional surface of the core materials, and then the thickness of the coating layer at eight sites i.e. 80 sites in total are measured at eight intersection points with the each of the core material surfaces, and the average thickness of the coating layers of 80 sites is defined as "d", it is preferable that the formula of $0.1\ \mu m \leqq d \leqq 2\ \mu m$ be satisfied, and it is more preferable that $0.1\ \mu m \leqq d \leqq 1\ \mu m$ be satisfied.

Figure 14:
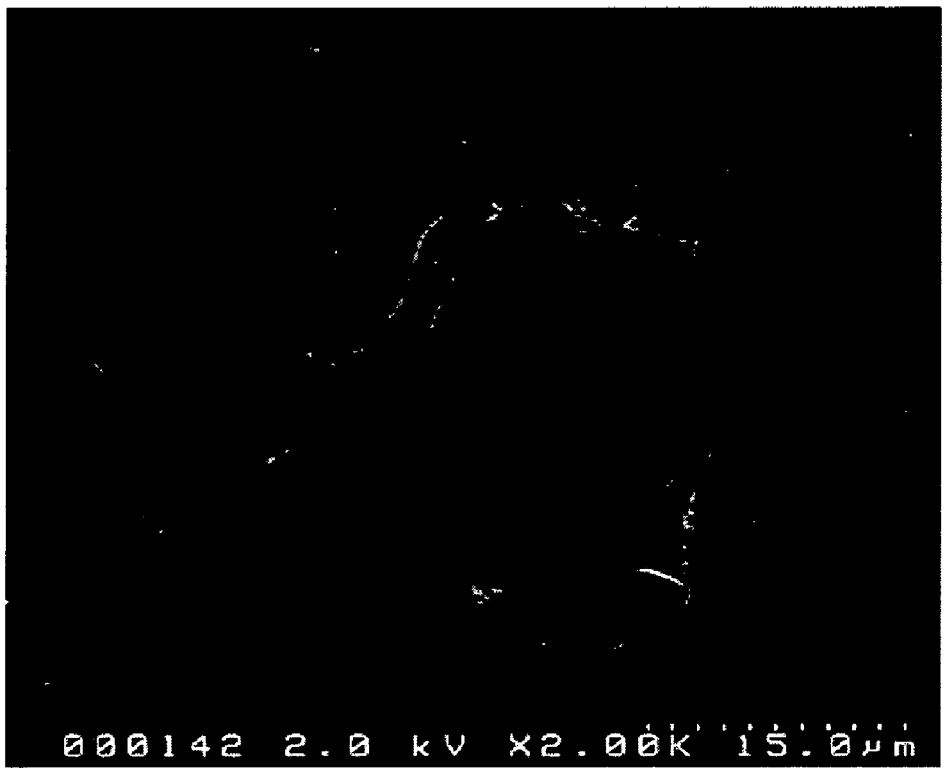
FIG. 14 is a cross-sectional scanning electron microscopic photograph of carrier 1 prepared in Example 1.
Figure 15:
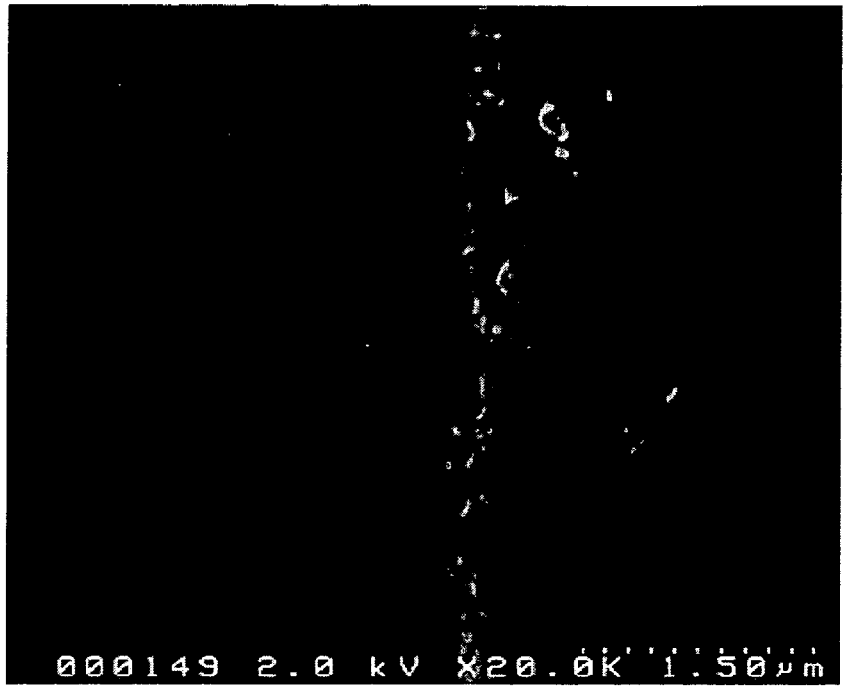
FIG. 15 is a partially enlarged photograph of FIG. 14.
Figure 16:
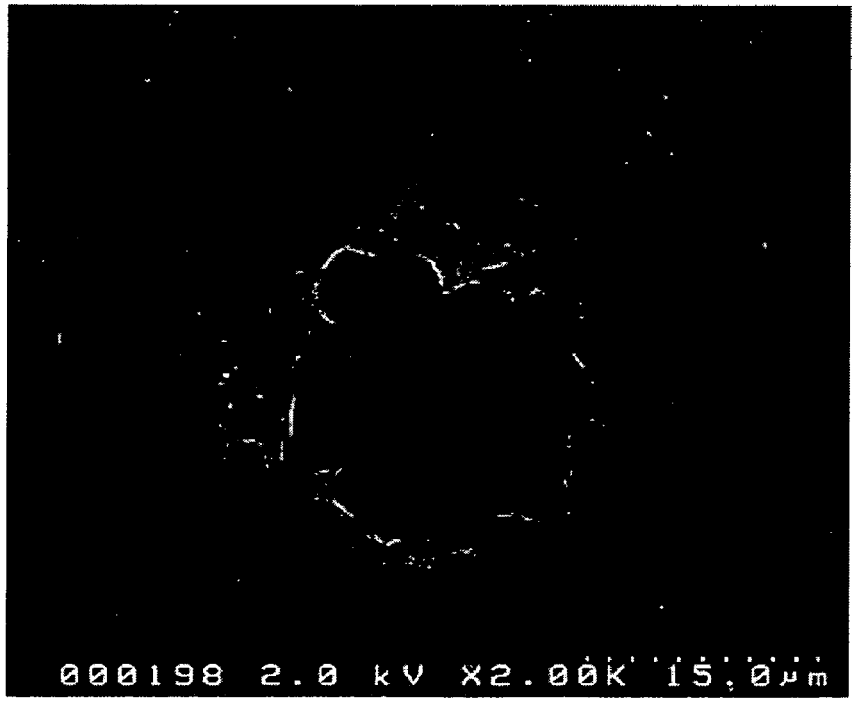
FIG. 16 is a cross-sectional scanning electron microscopic photograph of comparative carrier 1 prepared in Comparative Example 1.
Figure 17:
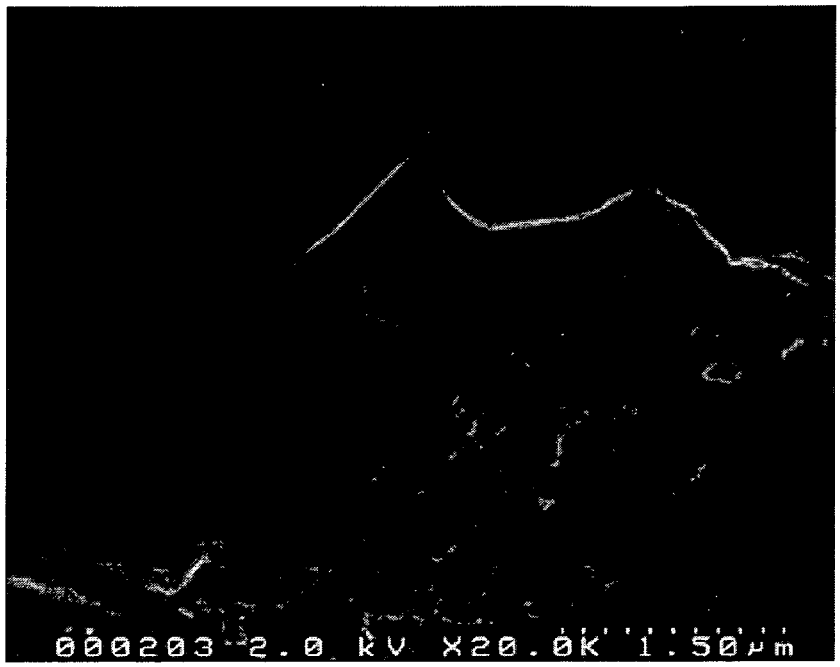
FIG. 17 is a partially enlarged photograph of FIG. 16.

Here, FIG. 14 is a scanning electron microscopic photograph showing a cross-sectional surface of a carrier having a coating layer on the core material surface, the coating layer is formed in a supercritical fluid in the present invention. FIG. 15 is a partially enlarged photograph of FIG. 14. FIG. 16 is a scanning electro microscopic photograph showing a cross-sectional surface of a carrier having a coating layer formed on the core material surface by a spray coating method using a conventional organic solvent. FIG. 17 is a partially enlarged photograph of FIG. 16.

When FIGS. 14 and 15 are compared with FIGS. 16 and 17, it is found that in the carrier shown in FIGS. 14 and 15, a film-exfoliation occurs, and with a spray coating method using a conventional organic solvent, the carrier has nonuniform thicknesses and nonuniform film quality because spray droplets cannot follow the form of microscopic convexo-concaves or irregularities on the carrier surface, and the carrier surface cannot be made wet sufficiently because the droplets are large relative to the carrier having smaller particle diameters and because of the interface tension of the droplets. Therefore the adhesiveness of the carrier is degraded, film exfoliation occurs, and the carrier has nonuniform film thicknesses and film quality. In contrast, with respect to a carrier produced by the method for producing a carrier of the present invention, a coating material can follow the form of the surface, and a smooth, dense, and uniformly formed thin layer having excellent adhesiveness can be formed on the surface.

The carrier of the present invention will be described in detail through the explanations of the first aspect to the fourth aspect of the method for producing a carrier.

<Formation of Coating Layer>

The formation of a coating layer is a step in which a coating layer is formed on the core material surface in a supercritical or subcritical fluid, and examples thereof include the first aspect to the fourth aspect of the present invention mentioned above.

—Supercritical Fluid and Subcritical Fluid—

The supercritical fluid means a fluid having an intermediate characteristic between gas and liquid, and having characteristics of speedy material migration and heat transfer and having low-viscosity, as well as enabling consecutively and largely varying the density, dielectric constant, solubility parameter, free volume, etc. by changing temperature and pressure. Further, since a supercritical fluid has extremely low interface tension compared to those of organic solvents, it can follow the form of a carrier surface even when the carrier surface has microscopic convexo-concaves, and the carrier surface can be made wet with the supercritical fluid.

The supercritical fluid is not particularly limited as long as it exists as a noncondensable high-density fluid in temperature and pressure ranges exceeding the limiting point (critical point) where a gas and a liquid can coexist, it is not condensed even when it is compressed, and it is a fluid in a state of the critical temperature or more and the critical pressure or more, and may be suitably selected in accordance with the intended use. However, the one having a low critical temperature and a low critical pressure is preferable. The subcritical fluid is not particularly limited as long as it exists as a liquid a high pressure in the range of temperature and pressure near the above-noted critical points, and may be suitably selected in accordance with the intended use.

Preferred examples of the supercritical fluid and the subcritical fluid include carbon monoxide, carbon dioxide, ammonia, nitrogen, water, methanol, ethanol, ethane, propane, 2,3-dimethylbutan, benzene, chlorotrifluoromethane, and dimethyl ether. Of these, carbon dioxide is particularly preferable because carbon dioxide has a critical pressure of 7.3 MPa, and a critical temperature of 31° C., can easily create a supercritical condition, is nonflammable and highly safe and allows obtaining a carrier having a hydrophobic surface because it is a nonaqueous solvent, and carbon oxide is gasified by just only restoring normal pressure and thus collection and recycling thereof are easy, and the obtained carrier needs no dry treatment and cause no waste fluid.

The supercritical fluid or the subcritical fluid may be used alone or may be used as a mixture of two or more.

The critical temperature and the critical pressure of the supercritical fluid are not particularly limited and may be suitably adjusted in accordance with the intended use, however the critical temperature is preferably −273° C. to 300° C., and more preferably 0° C. to 200° C. For the critical pressure, the lower the critical pressure the more advantageous in terms of equipment burden, facility cost, and operational energy, however, actually it is preferably 1 MPa to 100 MPa, and more preferably 1 MPa to 50 MPa.

In the present invention, a coating layer can be formed on the core material surface by utilizing characteristics of the supercritical fluid or the subcritical fluid in a positive way.

Further, since a supercritical fluid makes it easy to separate itself from target products and can be collected and recycled, the use of a supercritical fluid makes it possible to realize an epochal method for producing a carrier of low environmental burden, using no water and organic solvents without using water and organic solvents that have been used conventionally.

In addition to the supercritical fluid and the subcritical fluid, other fluids may be used in combination with them. For the other fluids, fluids by which the solubility of the toner component materials is easily controllable are preferable. Specific examples thereof include methane, ethane, propane, and ethylene.

In addition to the supercritical fluid and the subcritical fluid, an entrainer can also be added. By adding the entrainer, the solubility of a coating resin can be improved. The entrainer is not particularly limited and may be suitably selected in accordance with the intended use, however, it is preferably a polar organic solvent. Preferred examples of the polar organic solvent include methanol, ethanol, propanol, butanol, hexane, toluene, ethyl acetate, chloroform, dichloromethane, ammonia, melamine, urea, and ethylene glycol. Of these, lower alcohol solvents exhibiting a poor solvent property under the conditions of room temperature and normal pressure (25° C., 0.1 MPa) are suitably used.

For the entrainer, the one that does not let the core material and the coating resin dissolved or the one that is slightly swollen is preferable. Specifically, the difference between solubility parameter [SP value] and the solubility parameter [SP value] of the coating resin to be used is preferably 1.0 or more, more preferably 2.0 or more, and still more preferably 2.0 to 5.0. For example, relative to a silicone resin, it is preferable to use an alcohol system such as methanol, ethanol, and n-propanol which respectively have a high SP value, or to use n-hexane, and n-heptane, etc. which respectively have a low SP value. The difference between the solubility parameter [SP value] and the solubility parameter [SP value] of the coating resin is large, the wet property relative to the core material of the coating resin may be degraded, and excellent dispersibility of the coating resin may not be obtained.

The content of the entrainer in the mixed fluid of any one of the supercritical fluid and the subcritical fluid with the entrainer is preferably 0.1% by mass to 10% by mass, and more preferably 0.5% by mass to 5% by mass. When the content of the entrainer is less than 0.1% by mass, the effect of entrainer may be hardly obtained, and when the content is more than 10% by mass, the properties as liquid of the entrainer is exceedingly strong, and the supercritical or subcritical state may be hardly obtained.

—Resin for Coating—

The coating resin is not particularly limited, may be suitably selected from among known resins in accordance with the intended use. Examples thereof include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acryl monomer, copolymer of vinylidene fluoride and vinyl fluoride, fluoroterpolymers such as terpolymer of tetrafluoroethylene, vinylidene fluoride and nonfluorinated monomer. Each of these resins may be used alone or in combination with two or more. Of these, silicon resin is particularly preferable in terms of its high-effectiveness.

The silicone resin is not particularly limited, may be suitably selected from among generally known silicone resins, and for example, straight silicone resins represented by the following structural formula are preferable.

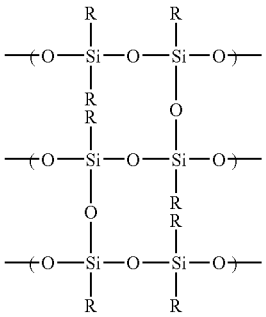

In the above structural formula, R represents a hydrogen atom, a hydroxyl group, an alkoxy group, an alkyl group, or an aryl group. Examples of the alkoxy group include methoxy groups, and ethoxy groups. Examples of the alkyl group include methyl groups, ethyl groups, and propyl groups. Examples of the aryl group include phenyl groups, tolyl groups, and xylyl groups.

The mass average molecular mass of the silicone resins as the coating resin is not particularly limited, may be suitably selected in accordance with the intended use, however, it is preferably 500 to 100,000, and more preferably 1,000 to 10,000.

For the silicone resin used for the coating resin, a solid silicone resin under the conditions of room temperature and normal pressure (25° C., 0.1 MPa) is preferable to a liquid silicone resin because of excellence in handleability, film-formation property, and film-thickness controllability.

The silanol concentration of the silicone resin as the coating resin is preferably 1% by mass to 40% by mass, and more preferably 1% by mass to 20% by mass, and still more preferably 1% by mass to 10% by mass for the purpose of being cross-linked after film-formation. When the silanol concentration is more than 40% by mass, the cross-linked film is easily hardened to become brittle, and the environmental stability of the carrier may be degraded because the durability of the coating resin is degraded, and unreacted silanol groups easily remain in the coating resin.

Here, the silanol concentration can be measured by the Karl-Fischer titration method described in the Japanese Industrial Standards (JIS) K0068 "Moisture Measuring Method of Chemical Product". The amount of sample and the preparation of a titration solvent are conformed to the titration method.

For the silicone resin, suitably synthesized ones may be used or commercially available ones may be used. Examples of the commercially available straight silicone resins include KR271, KR255, and KR152 manufactured by Shin-Etsu Chemical Co., Ltd.; and SR2400, SR2406, and SR2410, 217 Flake Resin, 220 Flake Resin, 233 Flake Resin, 249 Flake Resin, and Z-6018 Intermediate manufactured by TORAY DOW CORNING CO., LTD.

Examples of the modified silicone resins include KR206 which is modified with an alkyd resin, KR5208 which is modified with an acrylic resin, ES1001N which is modified with an epoxy resin, KR305 which is modified with a urethane resin, manufactured by Shin-Etsu Chemical Co., Ltd.; and SR2115 which is modified with an epoxy resin, and SR2110 which is modified with an alkyd resin, manufactured by TORAY DOW CORNING CO., LTD.

Each of these silicone resins may be used alone or may be used in combination with components capable of cross-linking, components capable of controlling the charged amount or the like.

—Core Material—

The core material is not particularly limited, may be suitably selected from those known as a two component carrier for electrophotography in the art in accordance with the intended use, and preferred examples thereof include ferrite, magnetite, iron, and nickel. In addition, in consideration of remarkably evolving environmental aspect of recent years, for example, Mn ferrite, Mn—Mg ferrite, and Mn—Mg—Sr ferrite are preferably used, not conventionally used copper-zinc ferrites.

For the core material, from the perspective of preventing carrier from adhering on or scattering across a latent electrostatic bearing member, those having a volume average particle diameter of 20 μm or more are preferable, and from the perspective of preventing degradation of image quality such as occurrence of carrier streaks, those having a volume average particle diameter of 100 μm or less are preferable, and particularly in view of high quality of image in recent years, the volume average particle diameter of the core material is more preferably 20 μm to 50 μm.

The first aspect of the method for producing a carrier of the present invention is that at least a coating resin is dissolved or dispersed in a supercritical or subcritical fluid to thereby form a coating layer on the core material surface.

The second aspect of the method for producing a carrier of the present invention is that a solution with at least a coating resin dissolved or dispersed therein is sprayed over a core material surface in a supercritical or subcritical fluid to thereby form a coating layer on the core material surface.

The third aspect of the method for producing a carrier of the present invention is that a solution in which at least a core material and a coating resin are contained and the coating resin is dissolved or dispersed, is pressurized and released in a supercritical or subcritical fluid and then rapidly expanded to thereby form a coating layer on the core material surface. This method for producing a carrier is a so-called rapid expansion supercritical solution (RESS) method.

In this case, it is preferable that a solution with at least a core material and a coating resin dissolved therein be pressurized and released in a supercritical fluid or subcritical fluid and rapidly expanded to thereby form a coating layer on the core material surface.

The RESS (Rapid Expansion Supercritical Solution) is a method in which a solute is dissolved in a supercritical fluid in a vessel, and the supercritical fluid is released outside the vessel at a time to reduce the inner pressure of the vessel and to precipitate the solute.

In contrast, the PGSS (Particles from gas Saturated Solution) method is a method in which the supercritical fluid is released outside the vessel at a time in a state where the solute is in an insoluble state (or in a molten state) in the supercritical fluid.

Here, the dissolved state means a state in which a sample material and a supercritical fluid are added to a high-pressure vessel equipped with an observation window, mixed therein, and left as it is for a given time, and when the content inside the high-pressure vessel is visually checked, it is cloudy or phase separation is observed.

Here, a case of coating a core material surface by RESS method and a case of coating a core material surface by PGSS will be described. When the RESS method is employed, a coating resin dissolved in a supercritical fluid will be precipitated on the surface of the core material as nucleus, and thus it is possible to obtain a carrier having a thin layer causing no cohesion of inter-core material particles, and single particles of the coating resin do not occur.

In contrast, when the PGSS method is employed, the inner pressure of the vessel was reduced in a state where a coating resin is insoluble to the supercritical fluid, and therefore, just only a carrier with a thick coating layer having a thickness of several μm or more can be obtained, and a large amount of single particles of the coating resin, and a large amount of cohesion particles containing plurality of core material particles occur. Further, as it is necessary to make the coating resin in a molten state (or in an insoluble state) in the supercritical fluid, in most cases, it is needed to use an entrainer (alcohols), and thereafter, the method tends to require a drying step and a waste liquid removing treatment. For example, the carrier coating by using the PGSS method is described in Japanese Patent Application Laid-Open (JP-A) Nos. 2006-106208 and 2006-91372.

In the third aspect of the method for producing a carrier of the present invention, a core material can be coated with a thin layer without causing inter-particle cohesion.

The fourth aspect of the method for producing a carrier of the present invention is that the solubility of a solution in which at least a core material and a coating resin are contained and the coating resin is dissolved or dispersed, is reduced by controlling at least any one of pressure and temperature in a supercritical or subcritical fluid to thereby form a coating layer on the core material surface (RESS) method.

In this case, it is preferable that the solubility of a solution with at least a core material and a coating resin dissolved therein be reduced by controlling at least one of pressure and temperature to form a coating layer on the core material surface.

As described above, the fourth aspect of the method for producing a carrier makes it possible to coat a core material with a thin layer by reducing the inside pressure of the vessel in a state where the solute is dissolved in a supercritical fluid, instead of using the RESS method. The method utilizes a reduction in the solubility of the coating resin by means of depressurization, and the coating resin is precipitated on the surface of the core material as nucleus. When employing this method, single resin fine particles do not occur, and it is possible to easily control the layer thickness.

The forming method of the coating layer is not particularly limited as long as the coating resin is dissolved or dispersed in the supercritical or subcritical fluid, and may be suitably selected in accordance with the intended use.

Here, the apparatus used for forming the coating layer is not particularly limited and may be suitably selected in accordance with the intended use, however, preferred examples thereof include an apparatus equipped with a pressure-proof vessel for dissolving and dispersing the coating resin and a pressurizing pump for supplying the supercritical fluid. For the treating method using the apparatus, at least the coating resin is poured in the pressure-proof vessel, the supercritical fluid is supplied into the pressure-proof vessel using a pressurizing pump, and the supercritical fluid is made contact with the coating resin to form a coating layer of the core material surface. Then, when the temperature and the pressure of the supercritical fluid are restored to room temperature and normal pressure (25° C., 0.1 MPa), the supercritical fluid is changed into a gas, and thus it requires no removal treatment of the solvent, and it also requires no waste fluid that would be generated in washing. Consequently, burdens to environments are alleviated.

The temperature in forming the coating layer on the core material surface is not particularly limited as long as it is higher than the critical temperature of the supercritical fluid or the subcritical fluid, and may be suitably adjusted in accordance with the intended use. Specifically, it is preferably 0° C. to 100° C., and more preferably 20° C. to 80° C. When the temperature is more than 100° C., the core material may be dissolved.

The pressure in forming the coating layer on the core material surface is not particularly limited as long as it is higher than the critical pressure of the supercritical fluid or the subcritical fluid, and may be suitably adjusted in accordance with the intended use, however, it is preferably 1 MPa to 60 MPa.

Here, the method of forming a coating layer on the core material surface will be described. In an apparatus shown in FIG. 1, a reaction vessel 119 having an inner volume of 1,000 $cm^3$ is used. In FIG. 1, the apparatus is equipped with an entrainer tank 112, pressurizing pumps 113 and 114, a temperature sensor 116, a spray nozzle 113, and a pressure sensor 134.

For a gas as a supercritical fluid, carbon dioxide ($CO_2$) was used. A composition containing at least a coating resin is poured in the reaction vessel 119.

Next, the carbon dioxide gas was supplied to the reaction vessel 119 from a gas cylinder 111 through a valve while increasing the pressure using the pressurizing pump 113. At this point in time, a valve 115 was kept closed, and carbon dioxide gas was not introduced to a spray vessel 132. Here, a depressurizing valve 118 for discharging and spraying was kept closed, and the pressure inside the reaction vessel 119 was increased. In addition, the temperature within the reaction vessel 119 was adjusted to 320K using heaters 137.

When the pressure inside the reaction vessel 119 was 7.3 MPa or more, the content inside the reaction vessel 119 became a supercritical condition. The pressure inside the reaction vessel 119 was set to 20 MPa by adjusting each valves 115 and 117 to make the composition containing at least the coating resin dissolved in the reaction vessel 119. The valves 115 and 117 were closed in this condition, and the dissolved condition of the content inside the reaction vessel 119 was kept for 120 minutes, and then the supercritical fluid was sufficiently diffused and circulated. Thereafter, the valve 117 was opened, the pressure inside the reaction vessel 119 was adjusted to 10 MPa, and the condition was kept as it was for 60 minutes. Thereafter, carbon dioxide gas was introduced again from the high-pressure pump, and the introduction of carbon dioxide was continued while maintaining the pressure inside the reaction vessel at 10 MPa. The carbon dioxide in the supercritical fluid contained in the mixed solution and the composition containing at least the coating resin dissolved in the supercritical carbon dioxide were collected by a collection system (not shown), and then the collected material was separated into carbon dioxide and a composition containing at least the coating resin to be reused, respectively.

By continuing the introduction of the supercritical carbon dioxide, the composition containing at least the coating resin which was dissolved inside the reaction vessel 119 was entirely discharged out of the reaction vessel 119, and only a carrier with a coating layer formed on the core material surface and the supercritical carbon dioxide fluid remained in the reaction vessel 119. Thereafter, the valve was opened, and the supercritical carbon dioxide gas was vaporized, thereby a carrier is produced.

Specifically, a coating layer can be formed on a core material surface in the following manner.

Figure 7:
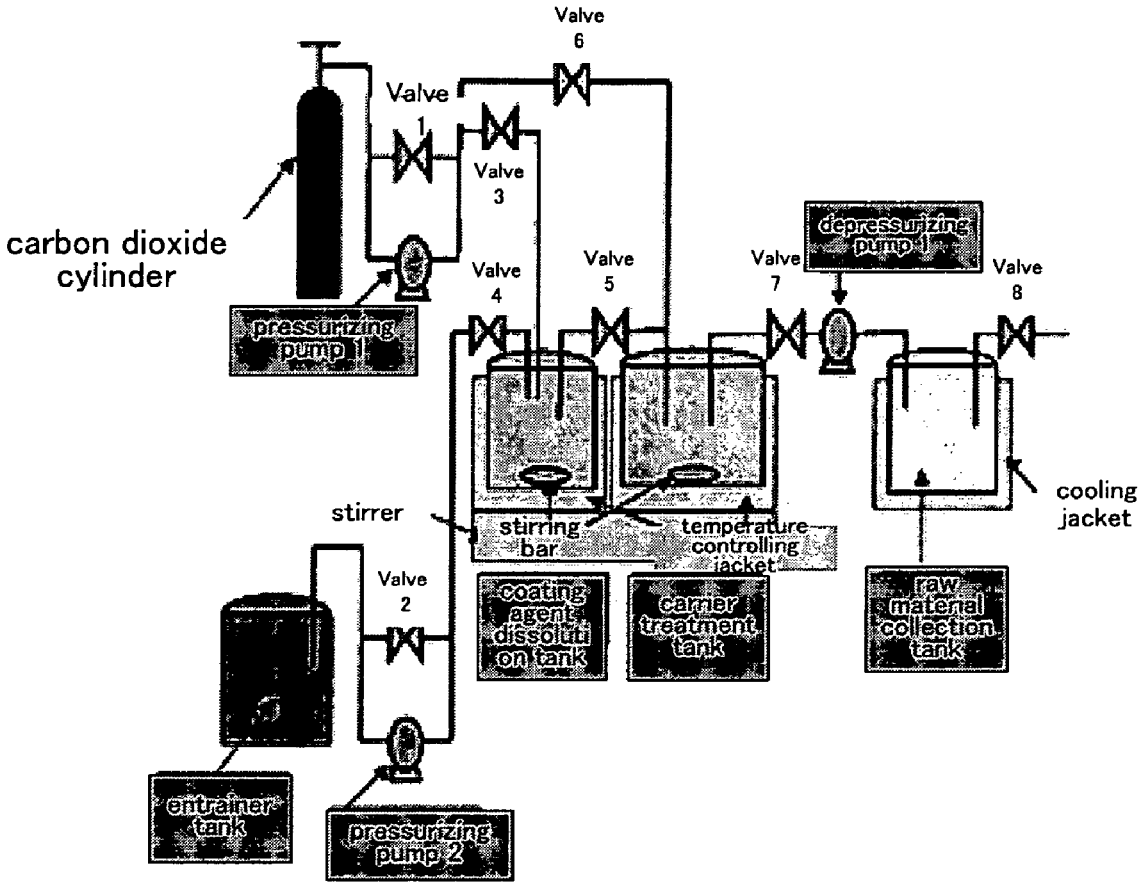
FIG. 7 is a schematic view of an apparatus used in the method for producing the carrier of Example 1.

Using an apparatus shown in FIG. 7, a coating resin and a catalyst were poured in a coating agent dissolution tank, a valve 3 was opened while agitating the materials, a carbon dioxide was supplied to the tank using a pressurizing pump 1, the pressure and the temperature were set at 25 MPa and 80° C., and then valve 3 was closed. A ferrite core material was poured into a carrier treatment tank, and then a valve 6 was opened while agitating the core material, a carbon dioxide was supplied to the carrier treatment tank using a pressurizing pump 1, the pressure and the temperature were set to 25 MPa and 80° C., and then the valve 6 was closed.

Next, valves 3, 5, and 7 were opened, the pressurizing pump 1 and the depressurizing pump 1 were put into action and then while controlling the inner pressure of the carrier treatment tank such that the condition of 25 MPa and 80° C. was maintained, the treatment liquid was circulated in the carrier treatment tank for 1 hour under the condition of normal pressures and a flow rate of 1 L/min to saturate the coating agent in the carrier treatment tank. The valve 3 was closed, and the pressure inside the carrier treatment tank was restored to normal pressure in 2 hours using the depressurizing pump 1. It was possible to collect non-used coating agent from both of the coating agent dissolution tank and a raw material collection tank and to recycle it.

It was possible to produce a carrier by heating the obtained ferrite core material coated with the silicone resin at 200° C. for 1 hour.

Figure 8:
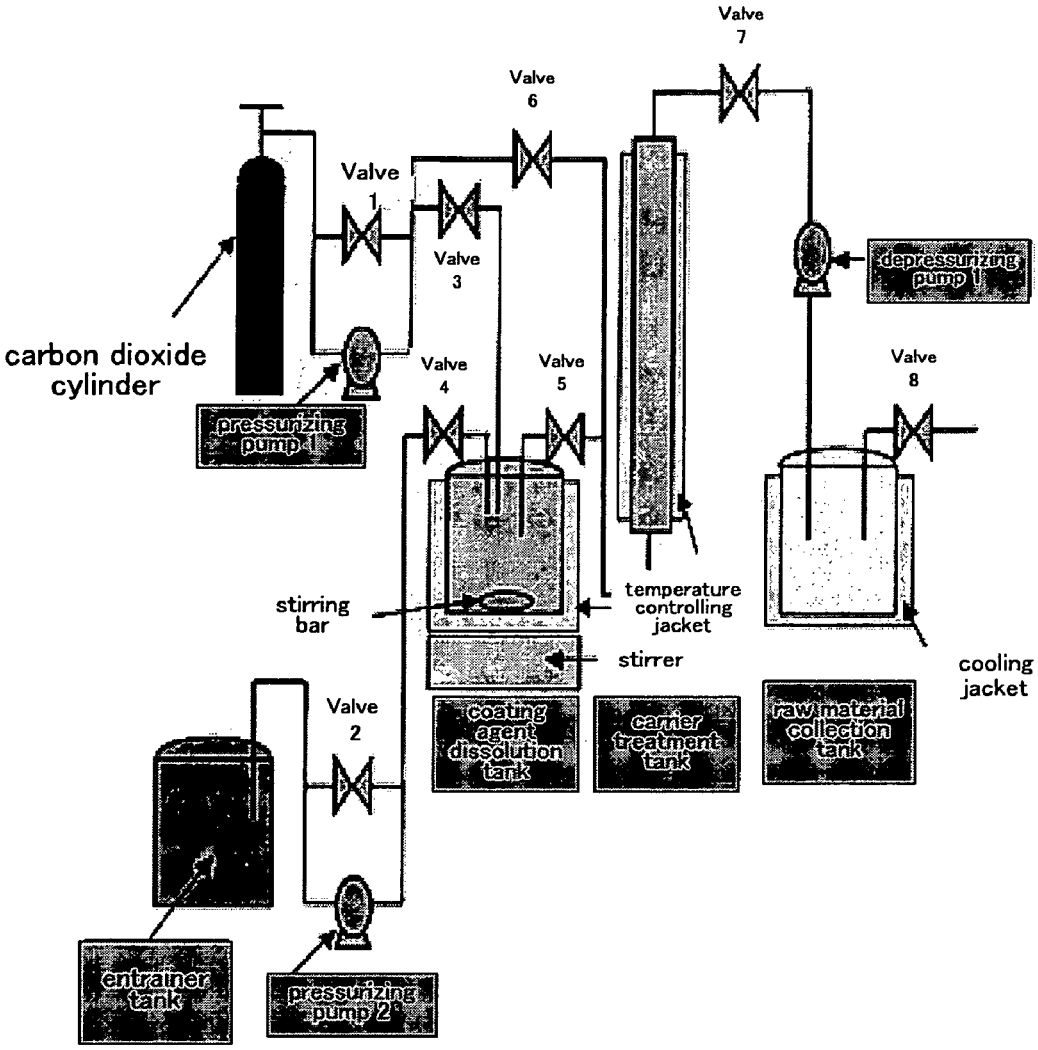
FIG. 8 is a schematic view of an apparatus used in the method for producing the carrier of Example 2.

Using an apparatus shown in FIG. 8, a silicone resin as the coating resin and a catalyst were poured into a coating agent dissolution tank.

A ferrite core material was poured into a carrier treatment tank, a valve 3 was opened, a carbon dioxide was supplied thereto using a pressurizing pump 1 while agitating the inside of the coating agent dissolution tank, the pressure and the temperature were set at 25 MPa and 60° C., and then the valve 3 was closed.

Next, valves 3, 5, and 7 were opened, the pressurizing pump 1 and the depressurizing pump 1 were put into action and then while controlling the inner pressure of the carrier treatment tank such that the condition of 25 MPa and 80° C. was maintained, the treatment liquid was circulated in the carrier treatment tank for 1 hour under the condition of normal pressure and a flow rate of 1 L/min to saturate the coating agent in the carrier treatment tank. It was possible to collect non-used coating agent from both of the coating agent dissolution tank and a raw material collection tank and to recycle it.

It was possible to produce a carrier by heating the obtained ferrite core material coated with the silicone resin at 200° C. for 1 hour.

Figure 9:
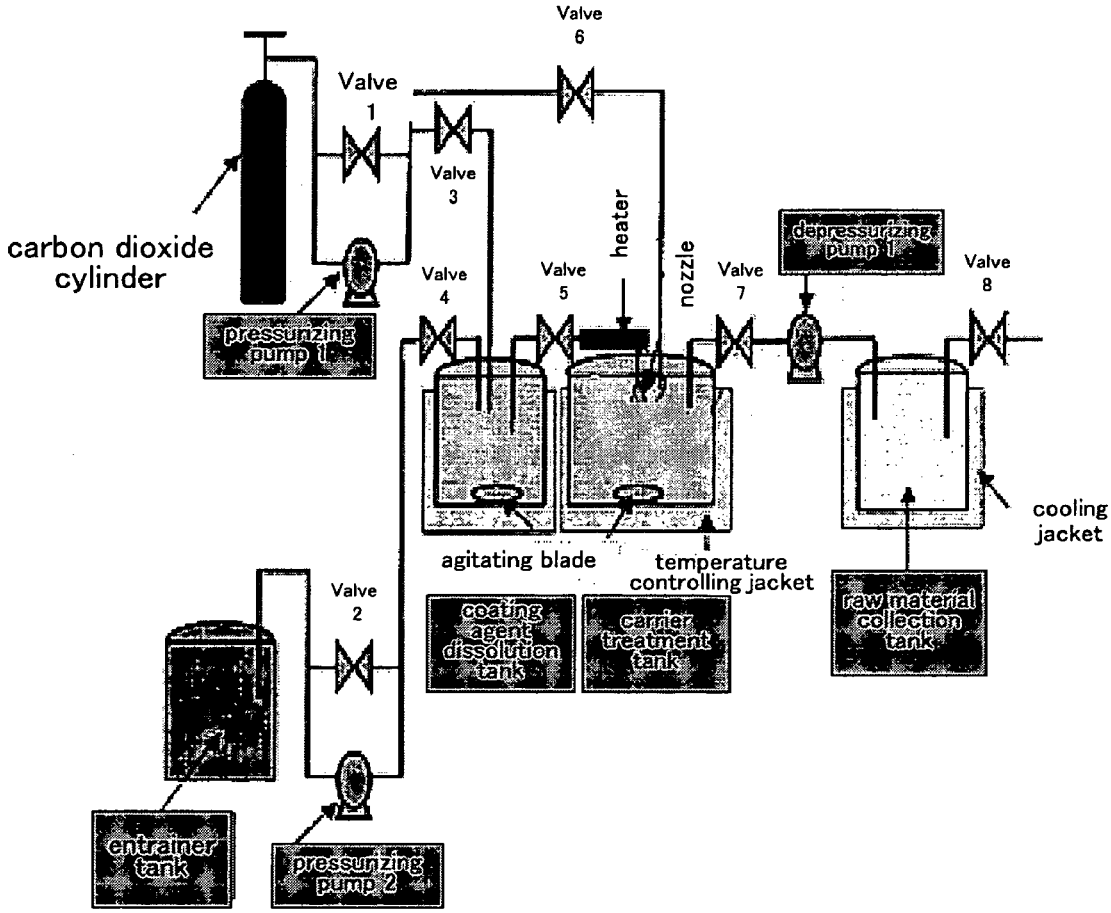
FIG. 9 is a schematic view of an apparatus used in the method for producing the carrier of Example 3.

In addition, using an apparatus shown in FIG. 9, a silicone resin as the coating resin and a catalyst were poured in a coating agent dissolution tank, a valve 3 was opened, and a carrier coating solution was prepared while supplying carbon dioxide using a pressurizing pump 1 and agitating the inside of the tank under the condition of 35 MPa and 40° C.

Next, a ferrite core material was poured into a carrier treatment tank equipped with a rotatable bottom plate, a valve 6 was opened, the pressure and the temperature inside the tank were set at 3 MPa and 100° C. and the valve 6 was closed. Thereafter, valves 5 and 6 were opened, a depressurizing pump 1 was put into action and then the inner pressure of the carrier treatment tank was controlled so as not to increase 7 MPa or more, and then the core material surface was coated with a carrier coating solution while agitating. It was possible to collect non-used coating agent from both of the coating agent dissolution tank and a raw material collection tank and to recycle it.

It was possible to produce a carrier by heating the obtained ferrite core material coated with the silicone resin at 200° C. for 1 hour.

Figure 10:
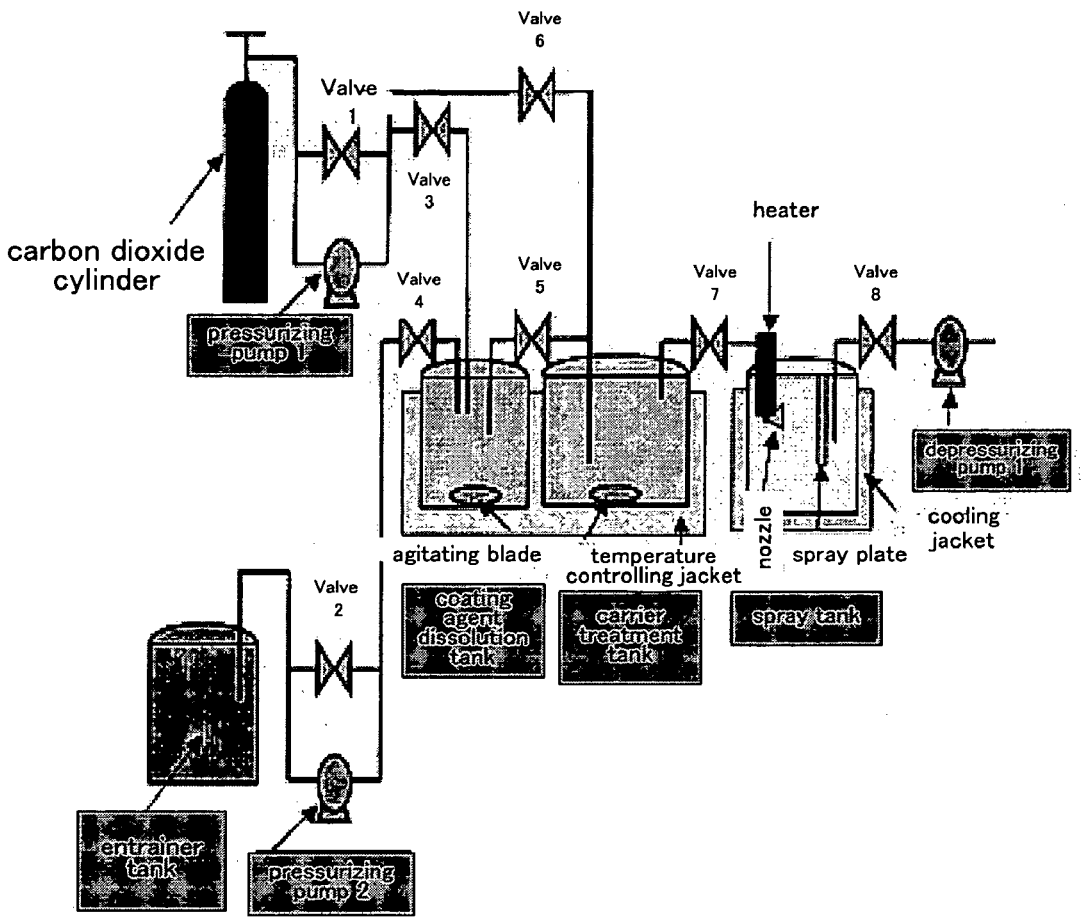
FIG. 10 is a schematic view of an apparatus used in the method for producing the carrier of Example 4.

Using an apparatus shown in FIG. 10, a silicone resin as the coating resin and a catalyst were poured in a coating agent dissolution tank. In the meantime, a ferrite core material was poured in a carrier treatment tank, valves 3 and 5 were opened, a carbon dioxide was supplied thereto using a pressurizing pump 1, and a ferrite dispersion liquid was prepared under the condition of 15 MPa and 80° C. while string. The obtained ferrite dispersion liquid was sprayed (rapidly expanded) from a nozzle of a spray tank set to an atmosphere of normal pressure and 30° C. It was possible to collect non-used coating agent from both of the coating agent dissolution tank and a raw material collection tank and to recycle it.

It was possible to produce a carrier by heating the obtained ferrite core material coated with the silicone resin at 200° C. for 1 hour.

(Developing Agent)

The developer of the present invention is a two-component developer which contains the carrier of the present invention and a toner.

For the mixed ratio of a toner and the carrier in the developer, the content of the toner is typically 1 part by mass to 10.0 parts by mass relative to 100 parts by mass of the carrier.

The toner contains at least a binder resin and a colorant, and further contains a releasing agent, a charge controlling agent, and other components in accordance with the necessity.

<Toner>

The method for producing a toner is not particularly limited and may be suitably selected in accordance with the intended use. Examples of the method include pulverization method, suspension polymerization method in which an oil phase is emulsified, suspended or flocculated in an aqueous medium to form toner-base particles, emulsification polymerization method, and polymer suspension method. Of these, pulverization method is particularly preferable.

—Binder Resin—

The binder resin is not particularly limited, may be suitably selected from among those known in the art in accordance with the intended use, and examples thereof include styrenes such as polystyrene, poly-p-styrene, and polyvinyl toluene, or the substitution monopolymers thereof; styrene copolymers such as styrene-p-chlorostyrene copolymers, styrene-propylene copolymers, styrene-vinyltoluene copolymers, styrene-methyl acrylate copolymers, styrene-ethyl acrylate copolymers, styrene-methacrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinylmethyl ether copolymers, styrene-vinylmethylketone copolymers, styrene-butadiene copolymers, styrene-isopropyl copolymers, and styrene-ester maleate copolymers; polymethyl methacrylate resins, polybutyl methacrylate resins, polyvinyl chloride resins, polyvinyl acetate resins, polyethylene resins, polyester resins, polyurethane resins, epoxy resins, polyvinyl butyral resins, polyacrylic resins, rosin resins, modified rosin resins, terpene resins, phenol resins, aliphatic or aromatic hydrocarbon resins, and aromatic petroleum resins. Each of these may be used alone or may be mixed in combination with two or more.

—Colorant—

The colorant is not particularly limited and may be selected from among known dyes and pigments in accordance with the intended use. Examples thereof include carbon black, nigrosine dye, iron black, naphthol yellow S, Hansa yellow (10G, 5G, and G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazinelake yellow, quinoline yellow lake, anthraene yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridon red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS, BC), indigo, ultramarine, iron blue, anthraquinon blue, fast violet B, methylviolet lake, cobalt purple, manganese Violet, dioxane violet, anthraquinon violet, chrome green, zinc green, chromium oxide, viridian green, emerald green, pigment green B, naphthol green B, green gold, acid green lake, malachite green lake, phthalocyanine green, anthraquinon green, titanium oxide, zinc flower, and lithopone.

Each of these colorants may be used alone or in combination with two or more. The content of the colorant to the toner is preferably 1% by mass to 15% by mass, and more preferably 3% by mass to 10% by mass.

The colorant may be used as a masterbatch compounded with a resin. The resin is not particularly limited, may be suitably selected from among those known in the art in accordance with the intended use, and examples thereof include styrenes or substitution polymers thereof, styrene copolymers, polymethyl methacrylate resin, polybutyl methacrylate resins, polyvinyl chlorides, polyvinyl acetate resins, polyethylene resins, polypropylene resins, polyester resins, epoxy resins, epoxypolyol resins, polyurethane resins, polyamides, polyvinylbutyrals, polyacrylic resins, rosins, modified rosins, terpene resins, aliphatic hydrocarbon resins, aromatic petroleum resins, chlorinated paraffins and paraffins. Each of these resins may be used alone or in combination with two or more.

—Releasing Agent—

The releasing agent is not particularly limited, may be suitably selected from among those known in the art in accordance with the intended use, and preferred examples thereof include waxes.

Examples of the waxes include carbonyl group-containing waxes, polyolefin waxes, and long-chain hydrocarbons. Each of these waxes may be used alone or in combination with two or more. Of these, carbonyl group containing waxes are preferable.

Examples of the carbonyl group containing waxes include polyalkanoic acid ester, polyalkanol ester, polyalkanoic acid amide, polyalkylamide, and dialkyl ketone. Examples of the polyalkanoic acid ester include carnauba wax, montan wax, trimethylol propane tribehenate, pentaerythritol tetrabehenate, pentaerythritol diacetate dibehenate, glycerin tribehenate, and 1,18-octadecandiol distearate. Examples of the polyalkanol ester include trimellitic tristearyl, and distearyl maleate. Examples of the polyalkanoic acid amide include dibehenylamide. Examples of the polyalkylamide include trimellitic tristearylamide. Examples of the dialkyl ketone include distearyl ketone. Of these carbonyl group containing wax include polyalkanoic acid ester is particularly preferable.

Examples of the polyolefin wax include polyethylene wax, and polypropylene wax.

Examples of the long chain hydrocarbon include paraffin wax and Sazole wax.

The melting point of the releasing agent is not particularly limited, may be suitably selected in accordance with the intended use, and it is preferably 40° C. to 160° C., more preferably 50° C. to 120° C., and particularly preferably 60° C. to 90° C.

The melting point is less than 40° C., the wax may adversely affect the heat-resisting storage stability, and the melting point is more than 160° C., there may be cases where cold offsets easily occur in fixing with low-temperature.

The melt viscosity of the releasing agent is, as a measured value at a temperature 20° C. higher than the melting point of the wax, preferably 5 cps to 1,000 cps, and more preferably 10 cps to 100 cps.

When the melt viscosity is less than 5 cps, the releasing property may be degraded, and when the melt viscosity is more than 1,000 cps, enhancement effects of the hot-offset property and low-temperature fixing property may not be obtained.

The content of the releasing agent in the toner is not particularly limited, may be suitably selected in accordance with the intended use, and it is preferably 1% by mass to 40% by mass, and more preferably 3% by mass to 30% by mass.

When the content of the releasing agent is more than 40% by mass, the flowability of the toner may be degraded.

—Charge Controlling Agent—

The charge controlling agent is not particularly limited and may be suitably selected from among positive or negative charge controlling agents in accordance with the positive or negative charge to be applied to a photoconductor.

For the negative charge controlling agent, for example, it is possible to use a resin, a compound, an azo dye, or an organic acid metal complex each having an electron-donatable functional group. Specific examples thereof include BONTRON (Article Nos. S-31, S-32, S-34, S-36, S-37, S-39, S-40, S-44, E-81, E-82, E-84, E-86, E-88, A, 1-A, 2-A, and 3-A) (manufactured by Orient Chemical Industries, Ltd.); Kayacharge (Article Nos. N-1 and N-2), Kayaset Black (Article Nos. T-2, and T-004) (all manufactured by Nippon Kayaku Co., Ltd.); Aizen Spiron Black (T-37, T-77, T-95, TRH, and TNS-2) (manufactured by Hodogaya Chemical Co.); and FCA-1001-N, FCA-1001-NB, and FCA-1001-NZ (manufactured by Fujikura Kasei Co., Ltd.).

For the positive charge controlling agent, it is possible to use, for example, a basic compound such as nigrosine dye, a cationic compound such as quaternary ammonium salt, and a metal salt such as higher fatty acid. Specific examples of the positive charge controlling agent include BONTRON (Article Nos. N-01, N-02, N-03, N-04, N-05, N-07, N-09, N-10, N-11, N-13, P-51, P-52, and AFP-B) (Orient Chemical Industries, Ltd.); TP-302, TP-415, and tP-4040 (manufactured by Hodogaya Chemical Co.); Copy Blue PR, and Copy Charge (Article Nos. PX-VP-435, and NX-VP-434) (manufactured by Hochst Corporation); FCA (Article Nos. 201, 201-B-1, 201-B-2, 201-B-3, 201-PB, 201-Pz, and 301) (manufactured by Fujikura Kasei Co., Ltd.); and PLZ (Article Nos. 1001, 2001, 6001, and 7001) (manufactured by SHIKOKU CHEMICALS CORP.).

Each of these positive charge controlling agents may be used alone or in combination with two or more.

The added amount of the charge controlling agent is determined by the method for producing a toner, including the type of the binder resin and the used dispersing method and is not uniformly limited, however, it is preferably 0.1 parts by mass to 10 parts by mass, and more preferably 0.2 parts by mass to 5 parts by mass relative to 100 parts by mass of the binder resin. When the added amount is more than 10 parts by mass, the exceedingly large charge property of the toner impairs the effect of the charge controlling agent, and the electrostatic attraction force with the developing roller(s) may be increased to cause reduction in flowability of the developer and reduction in image density. When the added amount is less than 0.1 parts by mass, insufficient charging start-up ability and charged amount may easily affect toner images.

Into the toner materials, it is possible to add inorganic fine particles, a flowability improving agent, a cleaning ability improving agent, a magnetic material, and a metal soap, etc., besides a binder resin, a releasing agent, a colorant, and a charge controlling agent.

For the inorganic fine particles, it is possible to use silica, titania, alumina, cerium oxide, strontium titanate, calcium carbonate, magnesium carbonate, calcium phosphate, and the like. And it is more preferable to use silica fine particles which are hydrophobized with silicone oil, hexamethyldisilazane or the like, or a titanium oxide that has been subjected to a specific surface treatment.

For the silica fine particles, it is possible to use, for example, Aerosil (Article Nos. 130, 200V, 200CF, 300, 300CF, 380, OX50, TT600, MOX80, MOX170, COK84, RX200, RY200, R972, R974, R976, R805, R811, R812, T805, R202, VT222, RX170, RXC, RA200, RA200H, RA200HS, RM50, RY200, and REA200) (manufactured by Nippon AEROSIL CO., LTD.); HDK (Article Nos. H20, H2000, H3004, H2000/4, H2050EP, H2015EP, H3050EP, and KHD50) and HVK2150 (manufactured by Wacker Chemicals, Ltd.); and CABOSIL (L-90, LM-130, LM-150, M-5, PTG, MS-55, H-5, HS-5, EH-5, LM-150D, M-7D, MS-75D, TS-720, and TS-610, TS-530) (manufactured by Cabot Corp.).

The added amount of the inorganic fine particles is preferably 0.1 parts by mass to 5.0 parts by mass, and more preferably 0.8 parts by mass to 3.2 parts by mass relative to 100 parts by mass of the toner base particles.

The above-noted toner materials are mixed, and the mixture is put in a melting kneader to fuse and knead it. For the melting kneader, it is possible to use a uniaxis or two-axis-consecutive kneader, and a batch type kneader using a roll mill. For example, KTK type two-axis extruder manufactured by KOBE STEEL., LTD.; TEM type two-axis extruder manufactured by TOSHIBA MACHINE CO., LTD.; two-axis extruder manufactured by KCK; PCM type two-axis extruder manufactured by IKEGAI, LTD.; and continuous type uniaxis extruder such as Co-kneader manufactured by BUSS are preferably used. It is preferred that these melting kneaders be used under appropriate conditions that does not bring separation of molecular chain of the binder resin. Specifically, the melting and kneading temperature is adjusted referring to the softening point of the binder resin. When the melting and kneading temperature is excessively higher than the softening point, molecular chains are bitterly separated, and the melting and kneading temperature may be excessively lower than the softening point, and the dispersion may not proceed.

In the pulverization, a kneaded product obtained in the kneading is pulverized. Specifically, in the pulverization, it is preferable that the obtained kneaded product be coarsely crushed and then finely pulverized. Preferred examples of the pulverizing method include a method in which a kneaded product is made collided with a collision place in a jet stream, and a method in which a kneaded product is pulverized in a gap between a mechanically rotating roller and a stirrer.

The pulverized product obtained in the pulverization is classified to control particles having predetermined particle diameters. The classification of particles can be performed by removing fine particles using, for example, a cyclone, a decanter, a centrifugal separator, or the like.

When the pulverization and classification of particles are completed, the pulverized product was classified in an airflow utilizing centrifugal force to thereby produce a toner having predetermined particle diameters.

To improve the flowability, storage stability, developing property, and transferring property of toner, inorganic fine particles such as a hydrophobic silica fine powder may be further added and mixed to the toner base particles that have been produced in the above-noted procedure. When the additives are mixed, a generally used mixer for powder is used, however, the mixer is preferably equipped with a jacket or the like to adjust the inside temperature. To change the history of load given to the additives, it may be achieved by adding the additives in the course of mixing or gradually adding the additives. In this case, the rotation number, rolling rate, rolling time, and temperature, and the like may be changed, or a high load may be first applied and then a relatively weak load may be applied, and conversely. Examples of the mixing equipment include V-type mixers, rocking mixers, Loedige mixers, Nauta mixers, and HENSCHEL MIXER. Then, the mixed toner particles are sieved through a sieve of 250 mesh or more to remove coarse particles and flocculated particles to thereby obtain a toner.

The toner is not particularly limited as to the shape, size, and the like may be suitably selected in accordance with the intended use, however, it is preferable that the toner has the following average circularity, volume average particle diameter, and the ratio of the volume average particle diameter to the number average particle diameter (volume average particle diameter/number average particle diameter).

The average circularity is a value that a circumferential length which is equal to a circle having an equal projection area to the toner shape is divided by the circumferential length of an actual particle. The average circularity is preferably 0.900 to 0.980, and more preferably 0.950 to 0.975. A toner having particles having the average circularity less than 0.94 in a content of 15% or less is preferable.

When the average circularity is less than 0.900, satisfactory transferring property and high-quality image without causing dust may not be obtained, and when the average circularity is more than 0.980, cleaning failures occur on the photoconductor and transferring belt, etc. in an image forming system employing blade cleaning, and in a case of image formation of an image with a high-image area ratio such as photographic imagery, the toner that has formed an untransferred image due to a sheet-feeding failure or the like may remain as untransferred residual toner on a photoconductor to cause background smear of accumulated images, or a charging roller for contact-charging the photoconductor may be polluted to prevent the intrinsic charge ability from exhibiting.

Here, the average circularity can be measured by using a flow particle image analyzer, for example, FPIA-2100; manufactured by SYSMEX Corp.

In 10 mL of water of a measured range of the number of particles having, for example, a circle equivalent diameter of 0.60 μm or more to less than 159.21 μm is 20 or less in $10^{-3}$ cm water in which microscopic waste has been removed through a filter, several droplets of a nonionic surfactant (preferably, Contaminon N, manufactured by Wako Pure Chemical Industries, Ltd.) are added, and further 5 mg of a measurement sample is added. Then, the mixture is subjected to a dispersion treatment using an ultrasonic dispersing device (UH-50, manufactured by SMT Corp. under the conditions of 20 kHz and 50 W/10 $cm^3$ for 1 minute, a dispersion treatment is further performed for 5 minutes to prepare a sample dispersion liquid having a density of particles of 4,000 pieces/$10^{-3}$ $cm^3$ to 8,000 pieces/$10^{-3}$ $cm^3$ (targeting particles having a diameter equivalent to that of an actually measured circle). By using the sample dispersion liquid, the particle size distribution of particles having a circle equivalent diameter of 0.60 μm or more and less than 159.21 μm.

The sample dispersion liquid is passed through a fluid channel of a flattened transparent flow cell having a thickness of approximately 200 μm, which is spread in the flow direction. To form an optical path passing through across the thickness of the flow cell, an electric flash and a CCD camera are attached to the flow particle image analyzer so as to sandwich the flow cell and be respectively positioned on the opposite side. During the sample dispersion liquid is flowed, light of the electric flash is applied at intervals of 1/30 seconds to obtain images of flowing particles in the flow cell. As the result, respective particles are taken as two-dimensional images each having a certain area in parallel with the flow cell. From the area of the two-dimensional image of respective particles, the diameter of a circle having the same area is calculated as the diameter of the circle.

The circle equivalent diameter for 1,200 pieces of particles can be measured in around one minute, the number of particles based on the circle equivalent diameter distribution, and the ratio of particles having defined circle equivalent diameters (% by No. of particles) can be measured. The result (% by frequency and % by accumulation) can be obtained by dividing the circle equivalent diameter range of 0.06 μm to 400 μm into 226 channels (divided into 30 channels for one octave). In an actual measurement, particles are measured in the range of a circle equivalent diameter of 0.60 μm to 159.21 μm.

The volume average particle diameter of the toner is not particularly limited and may be suitably selected in accordance with the intended use, however, it is preferably 3 μm to 10 μm, and more preferably 3 μm to 8 μm.

When the volume average particle diameter is less than 3 μm, in a two-component developer, the toner is fused on the carrier surface in a long-term agitation in a developing apparatus, and this may degrade the charge ability of the carrier. When the volume average particle diameter is more than 10 μm, a high-quality image is rarely obtained with high-resolution, and when toner output/input is performed in the developer, the toner particle diameter may be largely varied.

The ratio of the volume average particle diameter to the number average particle diameter in the toner (volume average particle diameter/number average particle diameter) is preferably 1.00 to 1.25, and more preferably 1.10 to 1.25.

Here, the ratio of the volume average particle diameter to the number average particle diameter (volume average particle diameter/number average particle diameter) can be determined by using Coulter Counter TA-II, and Coulter Multisizer II (both manufactured by Beckman Coulter, Inc.).

First, in 100 mL to 150 mL of an electrolytic aqueous solution, 0.1 mL to 5 mL of a surfactant (preferably, alkylbenzene sulfonate) was added as a dispersing agent. Here, the electrolytic aqueous solution represents a 1% by mass NaCl aqueous solution prepared by using primary sodium chloride, and using, for example, ISOTON-II (manufactured by Beckman Coulter, Inc.). A measurement sample in an amount of 2 mg to 20 mg was further added. The electrolytic aqueous solution with the sample suspended therein was subjected to a dispersing treatment for 1 minute to 3 minutes using an ultrasonic dispersing device. The volume of the toner and the number of toner particles were measured by using the measurement device through the use of a 100 μm aperture to calculate the weight distribution and the number distribution. Based on the obtained distribution results, the volume average particle diameter (Dv) and the number average particle diameter (Dn) of the toner can be determined.

As for channels, the following 13 channels were used. Namely, a channel of 2.00 μm to less than 2.52 μm; a channel of 2.52 μm to less than 3.17 μm; a channel of 3.17 μm to less than 4.00 μm; a channel of 4.00 μm to less than 5.04 μm; a channel of 5.04 μm to less than 6.35 μm; a channel of 6.35 μm to less than 8.00 μm; a channel of 8.00 μm to less than 10.08 μm; a channel of 10.08 μm to less than 12.70 μm; a channel of 12.70 μm to less than 16.00 μm; a channel of 16.00 μm to less than 20.20 μm; a channel of 20.20 μm to less than 25.40 μm; a channel of 25.40 μm to less than 32.00 μm; and a channel of 32.00 μm to less than 40.30 μm. And, particles having a particle diameter of 2.00 μm to 40.30 μm are intended for the measurement.

The coloring of the toner is not particularly limited and may be suitably selected in accordance with the intended use, for example, it is possible to use at least one selected from black toner, cyan toner, magenta toner, and yellow toner. Each of the color toners can be obtained by suitably selecting the type of the colorants, however, a color toner is preferable.

<Developer Container>

The developer container of the present invention houses the developer of the present invention.

The developer container of the present invention is not particularly limited, may be suitably selected from those known in the art, and preferred examples thereof include the one having a developer container main body and a cap thereof.

The developer container main body is not particularly limited as to the size, shape, structure, material or the like and may be suitably selected in accordance with the intended use. For example, with respect to the shape, cylindrical form is preferably used. A container main body is particularly preferable in which spiral convexoconcaves are formed on the inner circumference surface such that the contents of toner can be moved to the side of a toner-discharge aperture by rotating the developer container main body, and a part of the spiral portion or the whole thereof have an accordion function.

The material of the developer container main body is not particularly limited, may be suitably selected in accordance with the intended use, however, the one having excellent dimensional accuracy is preferable. Examples of the material of the developer container include polyester resins, polyethylene resins, polypropylene resins, polystyrene resins, polyvinyl chloride resins, polyacrylic resins, polycarbonate resins, ABS resins, and polyacetal resins.

The developer container used in the present invention is easily stored and transported, excels in handleability, and can be detachably mounted to the process cartridge, the image forming apparatus of the present invention or the like, which will be described hereinafter, to be suitably used for toner supply.

<Process Cartridge>

A process cartridge used in the present invention is provided with at least an image bearing member configured to carry a latent electrostatic image, and a developing unit configured to develop the latent electrostatic image carried on the image bearing member using a developer to form a visible image.

The developing unit is provided with at least a developer container to house the developer of the present invention; and a developer carrier configured to carry and transport the developer housed in the developer container and may be further provided with a layer thickness controlling member or the like for controlling the thickness of the toner layer to be carried thereon.

The process cartridge of the present invention is preferably capable of being detachably mounted on various types of image forming apparatuses, and it is particularly preferable that the process cartridge is detachably mounted on an image forming apparatus of the present invention which will be described hereinafter.

Figure 2:
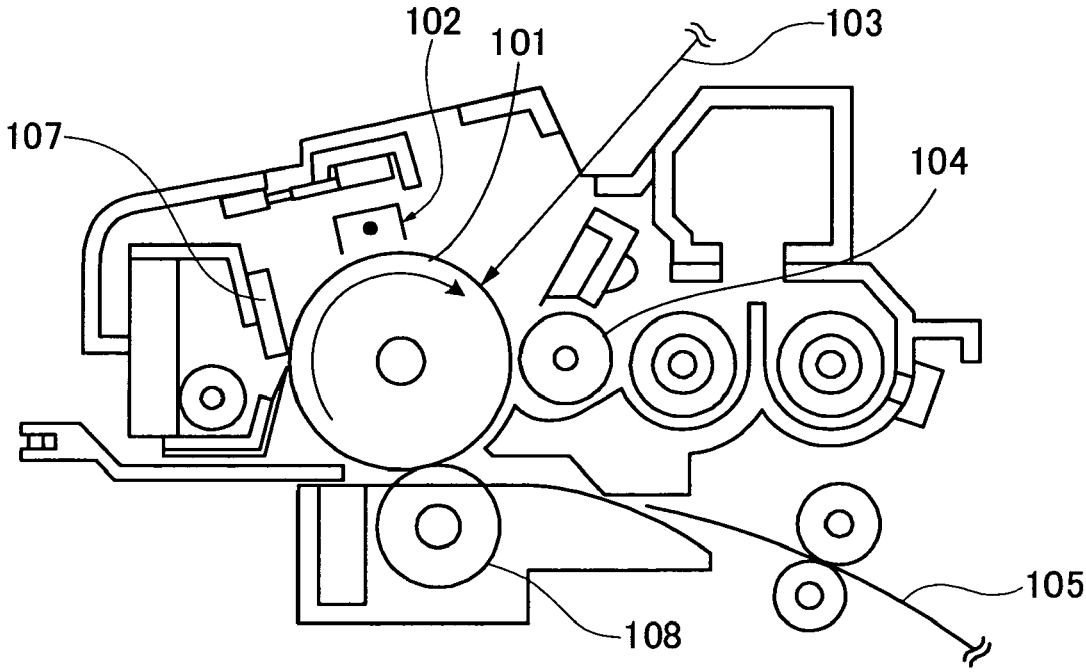
FIG. 2 is a view schematically illustrating one example of a process cartridge used in the present invention.

Here, as shown in FIG. 2, the process cartridge incorporates a latent electrostatic image bearing member 101, contains a charging unit 102, a developing unit 104, a transferring unit 108, and a cleaning unit 107, and further contains other units in accordance with the necessity. In FIG. 2, the reference numeral 103 represents an exposure light through an exposing unit, and 105 represents a recording medium.

Next, the image forming process using the process cartridge shown in FIG. 2 will be described below. While the latent electrostatic image bearing member 101 rotates in the direction indicated by the arrow, a latent electrostatic image corresponding to an exposed image is formed on the surface of the latent electrostatic image bearing member by a charge through the charging unit 102 and by exposure light 103 through the exposing unit (not shown). The latent electrostatic image is developed to a visible image by means of the developing unit 104, the obtained visible image is transferred onto a recording medium 105 by means of the transferring unit 108 and then printed out. Next, the surface of the latent electrostatic image bearing member after the image transfer is cleaned by means of the cleaning unit 107 and then electric charge remaining on the surface of the latent electrostatic image bearing member is eliminated by charge-eliminating unit (not shown). Thereafter, the above-noted operation is repeatedly performed again.

(Image Forming Method and Image Forming Apparatus)

The image forming method of the present invention includes at least latent electrostatic image forming, developing, transferring, and fixing and further includes other steps which are suitably selected in accordance with the necessity such as charge elimination, cleaning, recycling, and controlling.

The image forming apparatus of the present invention is provided with at least an image bearing member, a latent electrostatic image forming unit, a developing unit, a transferring unit, and a fixing unit and is further provided with other units which are suitably selected in accordance with the necessity such as a charge elimination unit, a cleaning unit, a recycling unit, and a controlling unit.

The latent electrostatic image forming is a step in which a latent electrostatic image is formed on an image bearing member.

The latent image bearing member (may be referred to as "electrophotographic photoconductor" or "photoconductor") is not particularly limited as to the material, shape, structure, size, or the like, and may be suitably selected from among those known in the art. With respect to the shape, drum-shaped one is preferably used. Preferred examples of the material used for the latent image bearing member include inorganic photoconductors made from amorphous silicon, selenium, or the like, and organic photoconductors made from polysilane, phthalopolymethine, or the like. Among these materials, amorphous silicons or the like are preferably used in terms of longer operating life.

The latent electrostatic image can be formed, for example, by charging the surface of the latent electrostatic image bearing member uniformly and then exposing the surface thereof imagewisely by means of the latent electrostatic image forming unit.

The latent electrostatic image forming unit includes, for example, at least a charger configured to uniformly charge the surface of the image bearing member, and an exposer configured to expose the surface of the image bearing member imagewisely.

The surface of the latent electrostatic image bearing member can be charged by applying a voltage to the surface of the image bearing member through the use of, for example, the charger.

The charger is not particularly limited, may be suitably selected in accordance with the intended use, and examples thereof include contact chargers known in the art, for example, which are equipped with a conductive or semi-conductive roller, brush, film, rubber blade or the like, and non-contact chargers utilizing corona discharge such as corotoron and scorotoron.

The charger is preferably arranged in a contact state or in a noncontact state with the latent electrostatic image bearing member and is configured to charge the surface of the latent electrostatic image bearing member by superimposingly applying a direct current or an alternating voltage to the charger.

In addition, the charger is preferably a charge roller closely arranged in a noncontact state to the latent electrostatic image bearing member through a gap tape and is configured to charge the surface of the latent electrostatic image bearing member by superimposingly applying a direct current or an alternating voltage to the charge roller.

The surface of the latent electrostatic image bearing member can be exposed by exposing the surface of the image bearing member imagewisely through the use of, for example, the exposer.

The exposer is not particularly limited, provided that the surface of the image bearing member which has been charged by the charger can be exposed imagewisely, may be suitably selected in accordance with the intended use, and examples thereof include various types of exposers such as reproducing optical systems, rod lens array systems, laser optical systems, and liquid crystal shutter optical systems.

In the present invention, the back light method may be employed in which exposing is performed imagewisely from the back side of the image bearing member.

—Developing and Developing Unit—

The developing is a step in which the latent electrostatic image is developed using the developer of the present invention to form a visible image.

The visible image can be formed by developing the latent electrostatic image using, for example, the developer by means of the developing unit.

The developing unit is not particularly limited, as long as a latent electrostatic image can be developed using the developer of the present invention, may be suitably selected from those known in the art, and preferred examples thereof include the one having at least an image developing apparatus which houses the developer therein and enables supplying the developer to the latent electrostatic image in contact or in non-contact. An image developing apparatus provided with the developer container of the present invention is more preferable.

The image developing apparatus may employ a dry-developing process or a wet-developing process. It may be an image developing apparatus for monochrome color or multicolors. Preferred examples thereof include the one having a stirrer by which the developer is frictionally stirred to be charged, and a rotatable magnet roller.

In the image developing apparatus, for example, the toner and the carrier are mixed and stirred, the toner is charged by frictional force at that time to be held in a state where the toner is standing on the surface of the rotating magnet roller to thereby form a magnetic brush. Since the magnet roller is arranged near the latent electrostatic image bearing member, a part of the toner constituting the magnetic brush formed on the surface of the magnet roller moves to the surface of the latent electrostatic image bearing member (photoconductor) by electric attraction force. As a result, the latent electrostatic image is developed using the toner to form a visible toner image on the surface of the latent electrostatic image bearing member (photoconductor).

The developer to be housed in the image developing apparatus is the developer of the present invention.

—Transferring and Transferring Unit—

In the transferring, the visible image is transferred onto a recording medium, and it is preferably an aspect in which an intermediate transfer member is used, the visible image is primarily transferred to the intermediate transfer member and then the visible image is secondarily transferred onto the recording medium. An aspect of the transferring is more preferable in which two or more color toners are used, still more preferably a full-color toner is used, and the aspect includes a primary transferring in which the visible image is transferred to an intermediate transfer member to form a composite transfer image, and a secondary transferring in which the composite transfer image is transferred onto a recording medium.

The transferring can be performed, for example, by charging a visible image formed on the surface of the image bearing member (photoconductor) using a transfer-charger to transfer the visible image, and it is possible by means of the transferring unit. For the transferring unit, it is preferably an aspect which includes a primary transferring unit configured to transfer the visible image to an intermediate transfer member to form to a composite transfer image, and a secondary transferring unit configured to transfer the composite transfer image onto a recording medium.

The intermediate transfer member is not particularly limited, may be suitably selected from among those known in the art in accordance with the intended use, and preferred examples thereof include transferring belts.

The transferring unit (the primary transferring unit and the secondary transferring unit) preferably includes at least an image-transferer configured to exfoliate the visible image formed on the latent electrostatic image bearing member to be charged and transfer the visible image onto the recording medium. For the transferring unit, there may be one transferring unit or two or more transferring units.

Examples of the image transferer include corona image transferers using corona discharge, transferring belts, transfer rollers, pressure transfer rollers, and adhesion image transfer units.

The recording medium is not particularly limited and may be suitably selected from among those known in the art.

—Fixing and Fixing Unit—

The fixing is a step in which a visible image which has been transferred onto a recording medium is fixed using a fixing apparatus, and the image fixing may be performed every time each color toner is transferred onto the recording medium or at a time so that each of individual color toners are superimposed at the same time.

The fixing apparatus is not particularly limited, may be suitably selected in accordance with the intended use, and heat-pressurizing units known in the art are preferably used. Examples of the heat-pressurizing units include a combination of a heat roller and a pressurizing roller, and a combination of a heat roller, a pressurizing roller, and an endless belt.

The fixing apparatus is preferably a unit which is provided with a heater equipped with a heat generator, a film making contact with the heater, and a pressurizing member making pressure-contact with the heater through the film and is configured to heat and fix a recording medium with an unfixed image formed thereon between the film and the pressurizing member.

The heating temperature in the heat-pressurizing unit is preferably 80° C. to 200° C.

In the present invention, for example, an optical fixing apparatus known in the art may be used along with or instead of the fixing and the fixing unit.

—Charge Elimination and Charge Elimination Unit—

The charge elimination is a step in which charge is eliminated by applying a charge-eliminating bias to the image bearing member, and it can be suitably performed by means of a charge-eliminating unit.

The charge-eliminating unit is not particularly limited as long as a charge-eliminating bias can be applied to the latent electrostatic image bearing member, and may be suitably selected from among charge-eliminating units known in the art. For example, a charge-eliminating lamp or the like is preferably used.

—Cleaning and Cleaning Unit—

The cleaning is a step in which a residual electrographic toner remaining on the latent electrostatic image bearing member is removed, and the cleaning can be preferably performed using a cleaning unit.

The cleaning unit is not particularly limited, provided that the residual electrophotographic toner remaining on the image bearing member can be removed, and may be suitably selected from among those known in the art. Examples of the cleaning unit include magnetic brush cleaners, electrostatic brush cleaners, magnetic roller cleaners, blade cleaners, brush cleaners, and web cleaners.

The recycling is a step in which the electrophotographic color toner that had been eliminated in the cleaning is recycled in the developing, and the recycling can be suitably performed by means of a recycling unit.

The recycling unit is not particularly limited, and examples thereof include carrying units known in the art.

The controlling is a step in which the above-noted individual steps are controlled, and the controlling can be suitably performed by means of a controlling unit.

The controlling unit is not particularly limited as long as it can control operations of the individual units, and may be suitably selected in accordance with the intended use. Examples thereof include equipment such as sequencers and computers.

An aspect of the image forming method of the present invention will be described with reference to FIG. 3 in which the image forming apparatus of the present invention is used.

Figure 3:
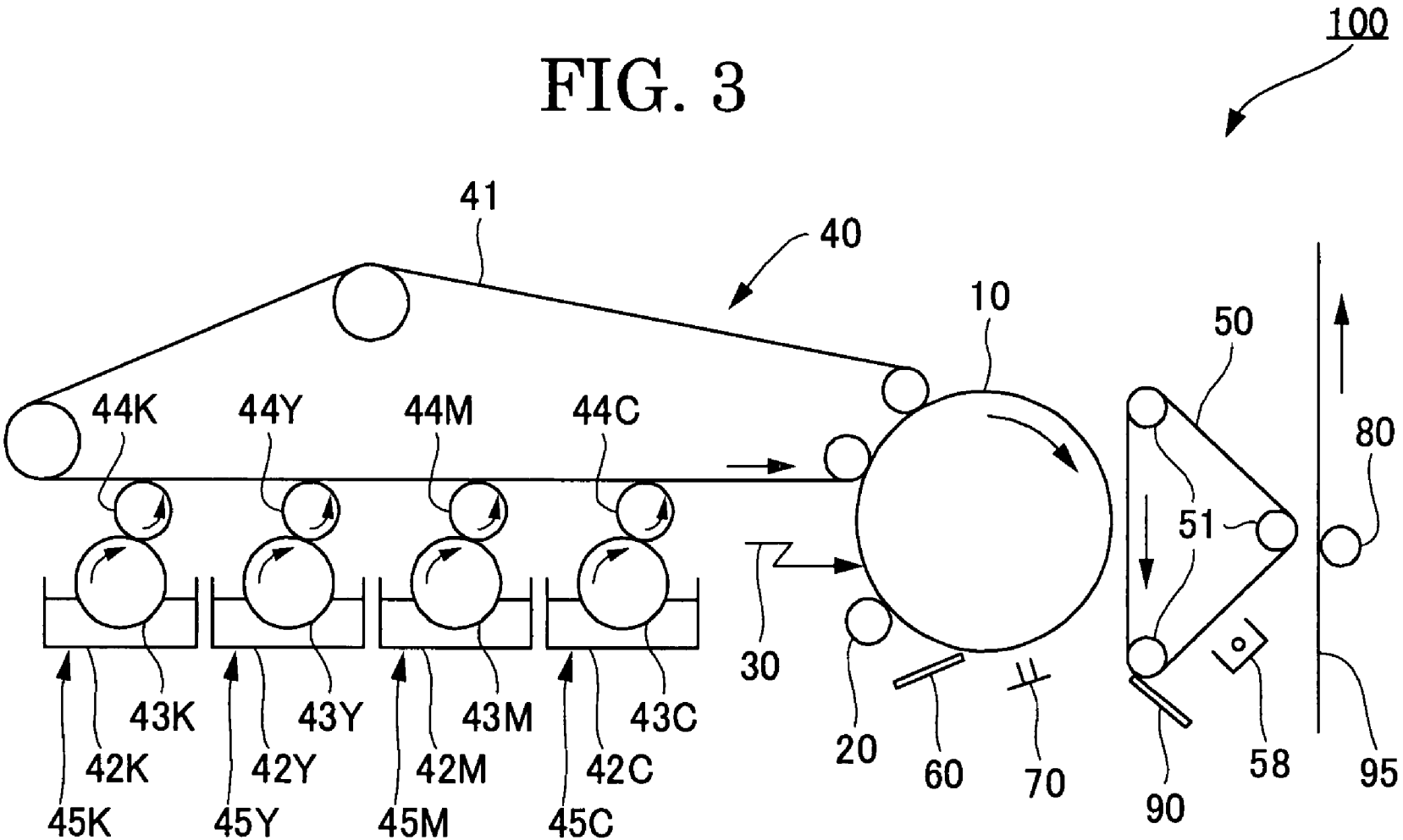
FIG. 3 is a view schematically illustrating one example of an image forming apparatus used in the image forming method of the present invention.

Image forming apparatus 100 shown in FIG. 3 is provided with a photoconductor drum 10, hereinafter it may be referred to as photoconductor 10, serving as the latent electrostatic image bearing member, a charge roller 20 serving as the charging unit, an exposer serving as the exposing unit, an image developing unit 40 serving as the developing unit, an intermediate transfer member 50, a cleaner 60 serving as the cleaning unit having a cleaning blade, and a charge-eliminating lamp 70 serving as the charge-eliminating unit.

The intermediate transfer member 50 is an endless belt and is designed such that the endless belt is spanned over three rollers 51 which are disposed inside thereof and driven in the direction indicated by the arrow shown in the figure. A part of the three rollers 51 also serves as a bias roller capable of applying a given bias for image transfer (primary transfer bias) to the intermediate transfer member 50. A cleaner 90 having a cleaning blade is arranged near the intermediate transfer member 50. A transfer roller 80 serving as the transferring unit is arranged so as to face the intermediate transfer member 50 and is capable of applying a bias for image transfer (secondary transferring) for transferring a visible image (toner image) to a recording medium 95. A corona charger 58 for applying a charge to the toner image on the intermediate transfer member 50 is arranged around the intermediate transfer member 50. The corona charger 58 is disposed between a contact area of the latent electrostatic image bearing member 10 and the intermediate transfer member 50 and another contact area of the intermediate transfer member 50 and the recording medium 95 in the direction of rotation of the intermediate transfer member 50.

The image developing unit 40 includes developing belt 41 as a developer carrier, black developing unit 45K, yellow developing unit 45Y, magenta developing unit 45M, and cyan developing unit 45C which are disposed around the developing belt 41. The black developing unit 45K includes developer holder 42K, developer feed roller 43K, and developing roller 44K. The yellow developing unit 45Y includes developer holder 42Y, developing feed roller 43Y, and developing roller 44Y. The magenta developing unit 45M includes developer holder 42M, developer feed roller 43M, and developing roller 44M. The cyan developing unit 45C includes developer holder 42C, developer feed roller 43C, and developing roller 44C. The developing belt 41 is formed in an endless belt and is rotatably spanned over plural belt rollers, a part of which is in contact with the latent electrostatic image bearing member 10.

In the image forming apparatus shown in FIG. 3, for example, the charge roller 20 uniformly charges the photoconductor drum 10. The exposer 30 exposes the photoconductor drum 10 imagewisely to form a latent electrostatic image thereon. The image developing unit 40 feeds the toner to the photoconductor drum 10 to develop the electrostatic latent image formed on the photoconductor drum 10 to thereby form a visible image i.e. a toner image. The visible image (toner image) is transferred to the intermediate transfer member 50 (primary transferring) and then transferred to the transferring sheet 95 (secondary transferring) by action of a voltage applied from the rollers 51, to thereby form a transferred image on the transferring sheet 95. Untransferred toner on the photoconductor 10 is removed by the cleaner 60, and the residual charge on the photoconductor 10 is removed once by means of the charge-eliminating lamp 70.

Figure 4:
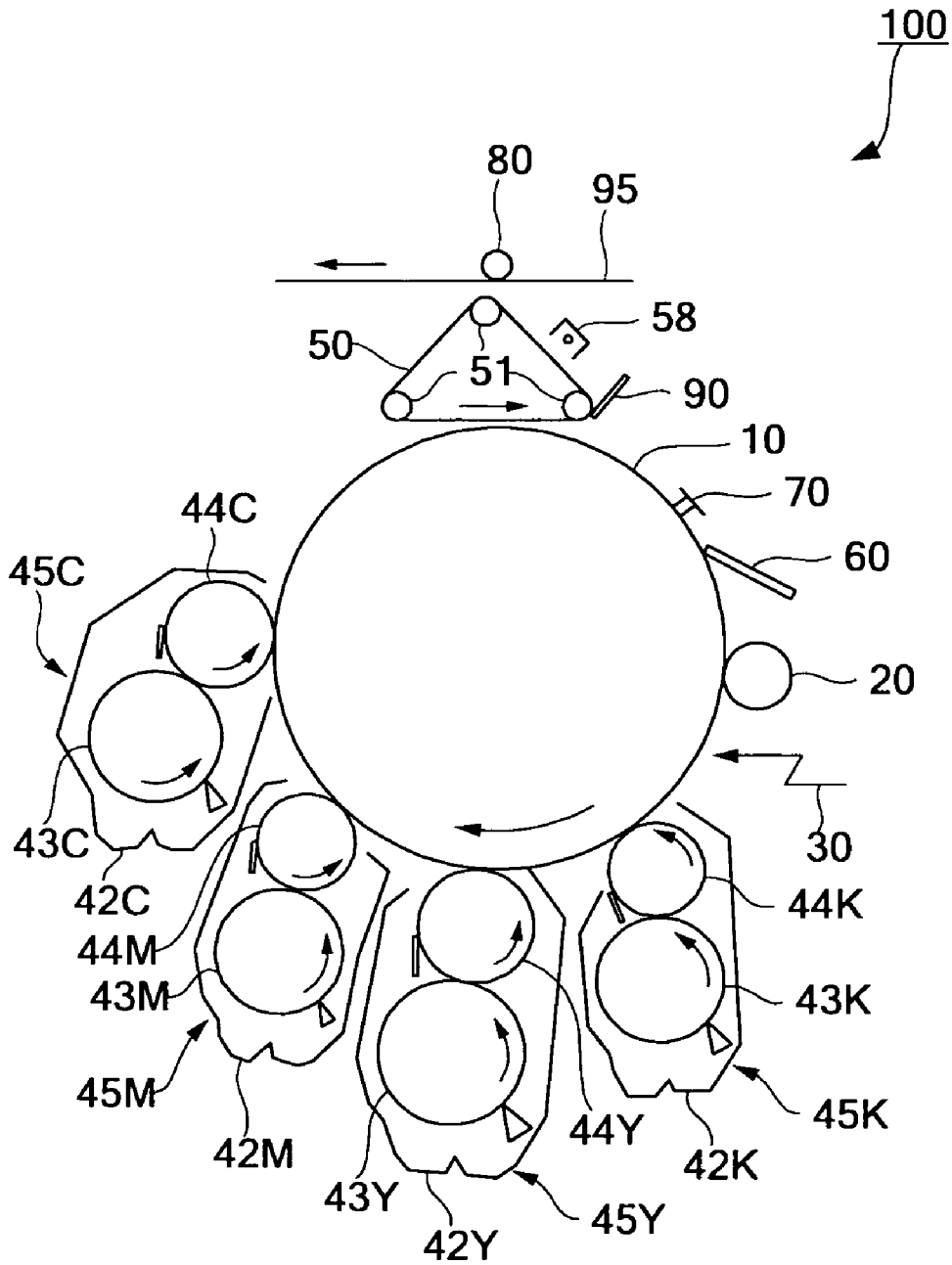
FIG. 4 is a view schematically illustrating another example of an image forming apparatus used in the image forming method of the present invention.

Another aspect of the image forming method using the image forming apparatus will be described with reference to FIG. 4. The image forming apparatus 100 shown in FIG. 4 has the same configuration and the same operational effects as in the image forming apparatus 100 shown in FIG. 3 except that the image forming apparatus 100 shown in FIG. 3 does not include developing belt 41, and black developing unit 45K, yellow developing unit 45Y, magenta developing unit 45M, and cyan developing unit 45C are arranged so as to surround and face photoconductor 10. In FIG. 4, the same components used as in FIG. 4 are respectively represented with the same reference numerals.

Figure 5:
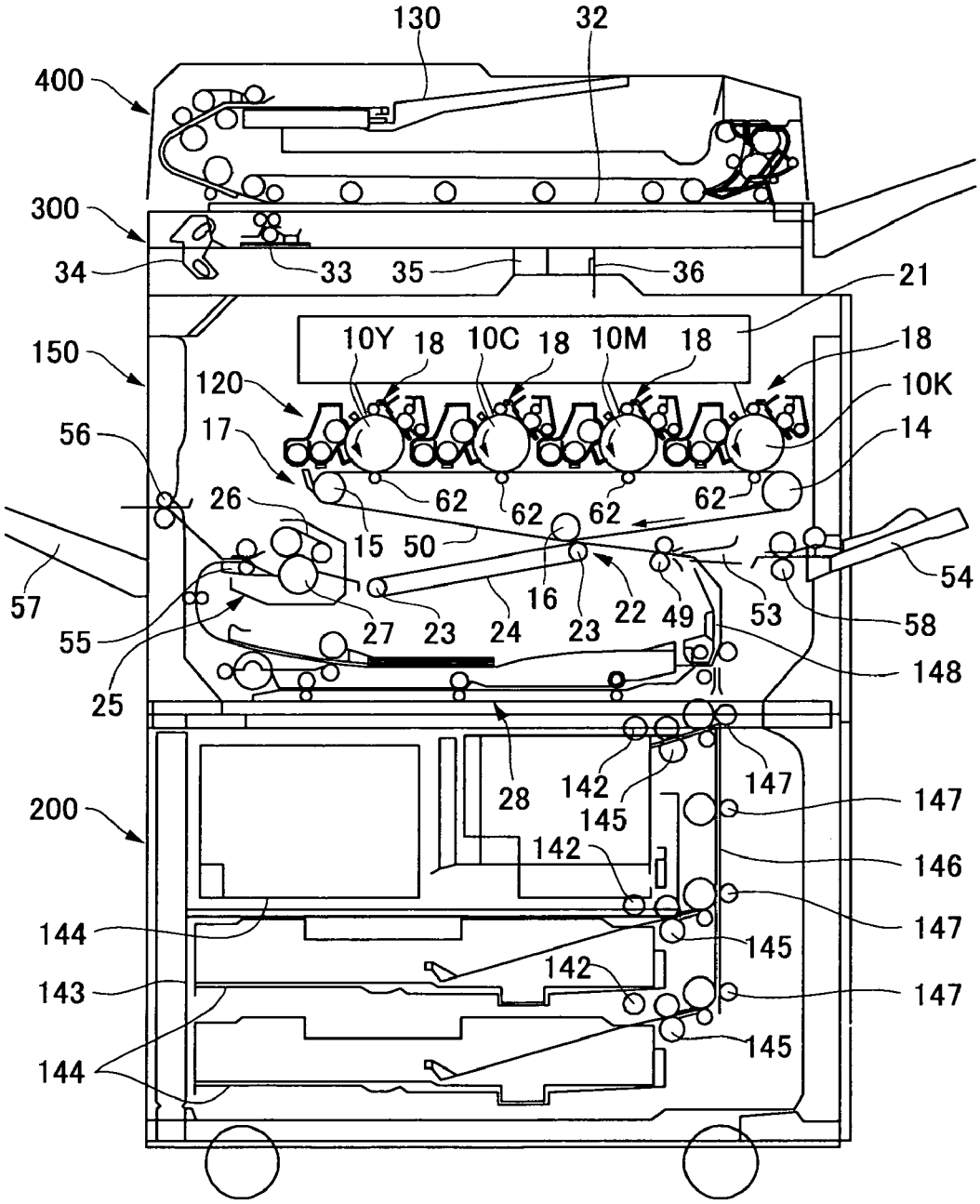
FIG. 5 is a view schematically illustrating one example of a tandem color image forming apparatus used in the image forming method of the present invention.

Still another aspect of the image forming method using the image forming apparatus will be described with reference to FIG. 5. A tandem image forming apparatus shown in FIG. 5 is a tandem type color image forming apparatus. The tandem image forming apparatus is provided with a copier main body 150, sheet-feeder table 200, scanner 300, and automatic document feeder (ADF) 400.

The copier main body 150 includes intermediate transfer member 50 formed in an endless belt at its center part. The intermediate transfer member 50 is spanned over three support rollers 14, 15, and 16 and is capable of rotating and moving in a clockwise direction in FIG. 5. An intermediate transfer member cleaner 17 capable of removing a residual toner on the intermediate transfer member 50 is arranged near the support roller 15. Above the intermediate transfer member 50 spanned between the first and second support rollers 14 and 15, yellow, cyan, magenta, and black image forming units 18 are arrayed in parallel in a moving direction of the intermediate transfer member 50 to thereby constitute a tandem image forming apparatus 120. Exposer 21 is arranged near the tandem image forming apparatus 120. Secondary image transferer 22 faces the tandem image developing apparatus 120 with the interposition of the intermediate transfer member 50. The secondary transferer 22 has secondary transferring belt 24 serving as an endless belt spanned over a pair of rollers 23. The transferring sheet being transported on the secondary transferring belt 24 is capable of contact the intermediate transfer member 50. Image fixing apparatus 25 is arranged on the side of the secondary image-transferer 22. The fixing apparatus 25 has fixing belt 26 which is an endless belt, and pressure roller 27 which is arranged so as to be pressed by the fixing belt 26.

The tandem image forming apparatus is further provided with a sheet reverser 28 in the vicinity of the secondary image-transferer 22 and the fixing apparatus 25. The sheet reverser 28 is capable of reversing the transferring sheet so as to form images on both sides of the transferring sheet.

Next, full-color image forming i.e. color copying using the tandem image forming apparatus will be described below. Initially, a document is placed on document platen 130 of automatic document feeder (ADF) 400. Alternatively, the automatic document feeder (ADF) 400 is opened, a document is placed on contact glass 32 of scanner 300, and the automatic document feeder (ADF) 400 is closed to press the document.

When pushing a start switch (not shown), the document placed on the automatic document feeder 400 is transported onto the contact glass 32. When the document is initially placed on the contact glass 32, by pushing the start switch (not shown), the scanner 300 is immediately driven to operate first carriage 33 and second carriage 34. Light is applied from a light source to the document by action of the first carriage 33, and reflected light from the document is further reflected toward the second carriage 34. The reflected light is further reflected by a mirror of the second carriage 34 and passes through image-forming lens 35 into read sensor 36 to thereby read the color image and to produce black, yellow, magenta, and cyan image information.

Figure 6:
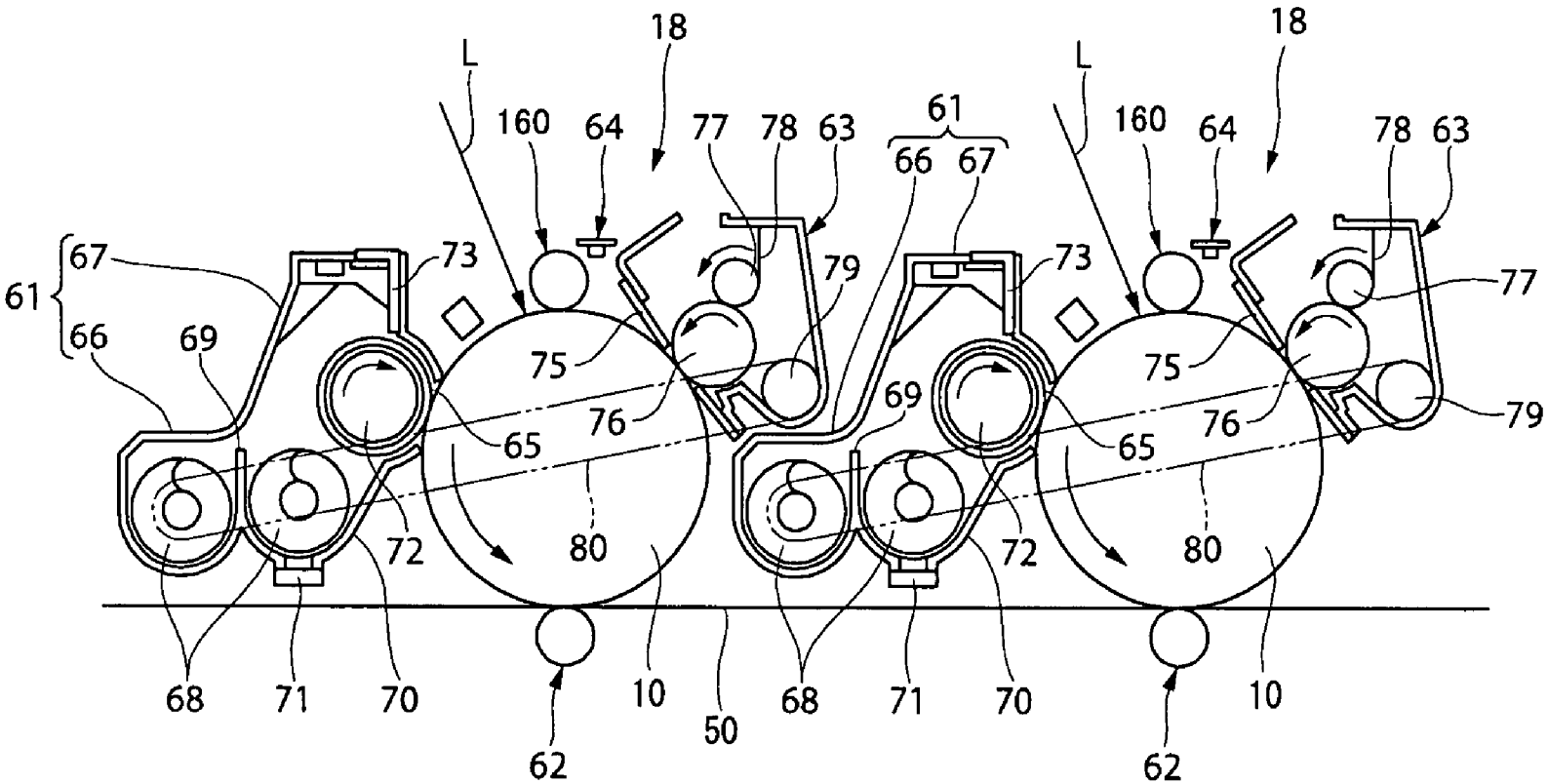
FIG. 6 is a partially enlarged schematic view of the image forming apparatus shown in FIG. 5.

Each of the black, yellow, magenta, and cyan image information is transmitted to each of the image forming units 18 for black, yellow, magenta, and cyan image forming in the tandem image forming apparatus to thereby form black, yellow, magenta, and cyan toner image therein. Specifically, each of the image forming units 18 in the tandem image forming apparatus is provided, as shown FIG. 6, with photoconductor 10 (black photoconductor 10K, yellow photoconductor 10Y, magenta photoconductor 10M, and cyan photoconductor 10C), charger 160 for charging the surface of the photoconductor 10 uniformly; exposer for exposing the photoconductor 110 in each color image imagewisely based on the each color image information to form latent electrostatic images corresponding to the each individual color image on the photoconductor 10, the exposer is indicated by L in FIG. 6; image developing unit 61 configured to develop the latent electrostatic images using respective color toners of black toner, yellow toner, magenta toner, and cyan toner to form toner images corresponding to each color toner; transfer charger 62 for transferring the latent electrostatic images onto intermediate transfer member 50; photoconductor cleaner 63; and charge-eliminator 64, and it is possible to form each of the monochrome images in black, yellow, magenta, and cyan based on each of the color image information. The black image formed on the respective photoconductors for black 10K, the yellow image formed on the photoconductor for yellow 10Y, the magenta image formed on the photoconductor for magenta 10M, and the cyan image formed on the photoconductor for cyan 10C are sequentially transferred onto the intermediate transfer member 50 which is rotatably moved by the support rollers 14, 15, and 16 in the primary transferring. Then, the black image, the yellow image, magenta image, and the cyan image are superimposed on the intermediate transfer member 50 to thereby form a composite color image i.e. a transferred color image.

One of feeder rollers 142 in the sheet-feeder table 200 is selectively rotated, recording paper sheets are ejected from one of multiple feeder cassettes 144 in paper bank 143, are separated by separation roller 145 one by one, one recording sheet is sent into feeder path 146, transported by a transport roller 147 into feeder path 148 in the copier main body 150 and is bumped against resist roller 49. Alternatively, feeder roller 142 is rotated to eject recording paper sheets on manual bypass tray 54, the recording sheets are separated one by one by separation roller 145, and one recording sheet is sent into manual bypass feeder path 53 and then similarly bumped against the resist roller 49. The resist roller 49 is typically grounded, however, it may be used under application of a bias to remove paper dust of the sheets.

The resist roller 49 is rotated in synchronization with the movement of the composite color image i.e. the transferred color image on the intermediate transfer member 50 to transport the sheet (recording paper) into between the intermediate transfer member 50 and the secondary image transferer 22, and the composite color image is transferred onto the recording sheet by action of the secondary image transferer 22 (secondary transferring) to thereby transfer the composite color image onto the recording sheet and form a color image thereon. Separately, the intermediate transfer member cleaner 17 removes a residual toner on the intermediate transfer member 50 after the image transfer.

The recording sheet bearing the color image is transported by the secondary transferer 22 into the fixing apparatus 25, applied with heat and pressure in the fixing apparatus 25, and the composite color image (color transfer image) is fixed on the recording sheet. Thereafter, the recording sheet changes its direction by action of the switch blade 55, ejected by an ejecting roller 56 to be stacked on output tray 57. Alternatively, the recording sheet changes its direction by action of the switch blade 55 into the sheet reverser 28, turns therein, is transported again to the transfer position, followed by image formation on the back surface of the recording sheet. The recording sheet bearing images on both sides thereof is ejected through the ejecting roller 56 to be stacked on the output tray 57.

According to the image forming apparatus and the image forming method of the present invention, it is possible to efficiently obtain a high-quality image because a developer is used in which the carrier of the present invention having high-mechanical strength, excelling in toner charge ability, temporal stability, and having excellent adhesiveness, and a coating layer having a uniform thickness is contained.

EXAMPLES

Hereafter, the present invention will be further described in detail referring to specific examples, however, the present invention is not limited to the disclosed examples.

Production Example 1

Preparation of Toner 1

First, 100 parts by mass of a polyester resin (mass average molecular mass=12,000), 2 parts by mass of a copper phthalocyanine pigment, and 2 parts by mass of a charge controlling agent represented by the following structural formula were kneaded at 120° C. using a heat roller, and the kneaded material was cooled, solidified, pulverized, and then classified to thereby obtain a cyan toner having a volume average particle diameter of 7.1 μm.

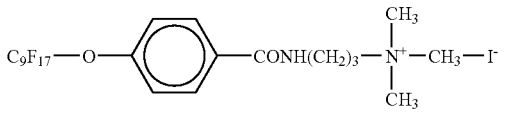

Next, relative to 100 parts by mass of the obtained toner, 0.5 parts by mass of Silica R972 (manufactured by Nippon AEROSIL CO., LTD.) was added, and the toner material was mixed to thereby prepare toner 1.

Production Example 2

Preparation of Toner 2

First, 100 parts by mass of a polyester resin (mass average molecular mass=12,000), 5 parts by mass of carbon black, and 2 parts by mass of a chrome-contained azo dye represented by the following structural formula were kneaded at 120° C. using a heat roller, and the kneaded material was cooled, solidified, pulverized, and then classified to thereby obtain a black toner having a volume average particle diameter of 7.3 μm.

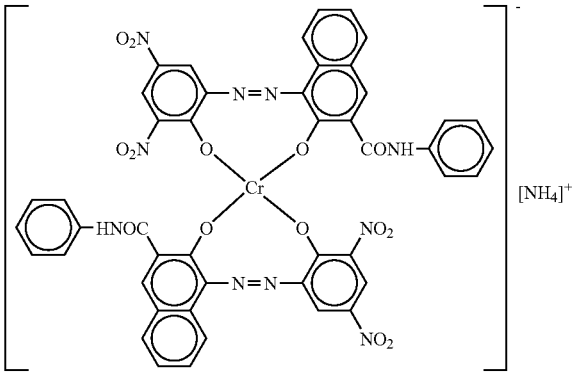

Next, relative to 100 parts by mass of the obtained toner, 0.5 parts by mass of Silica R972 (manufactured by Nippon AEROSIL CO., LTD.) was added, and the toner material was mixed to thereby prepare toner 2.

Production Example 3

Preparation of Toner 3

—Synthesis of Organic Fine Particle Emulsion—

To a reaction vessel provided with a stirrer and a thermometer, 683 parts by mass of water, 11 parts by mass of sodium salt of the sulfuric acid ester of methacrylic acid ethylene oxide adduct (ELEMINOL RS-30, manufactured by Sanyo Chemical Industries, Ltd.), 83 parts by mass of styrene, 83 parts by mass of methacrylic acid, 110 parts by mass of butyl acrylate, and 1 part by mass of ammonium persulphate were poured, and stirred at 400 rpm for 15 minutes to obtain a white emulsion. The white emulsion was heated, the temperature in the system was raised to 75° C. and the reaction was performed for 5 hours. Next, 30 parts by mass of an aqueous solution of 1% by mass ammonium persulphate was added, and the reaction mixture was matured at 75° C. for 5 hours to obtain an aqueous dispersion liquid of a vinyl resin (copolymer of styrene-methacrylic acid-butyl acrylate-sodium salt of the sulfuric acid ester of methacrylic acid ethylene oxide adduct). This aqueous solution was taken as particulate emulsion 1. The volume average particle diameter of particulate emulsion 1 measured by a laser diffraction particle size distribution analyzer (LA-920, manufactured by HORIBA Instruments Inc.) was 105 nm. After drying part of particulate emulsion 1 and isolating the resin, the glass transition temperature (Tg) of the resin was 59° C. and the mass average molecular mass was 150,000.

—Preparation of Aqueous Phase—

To 990 parts by mass of water, 83 parts by mass of particulate emulsion 1, 37 parts by mass of a 48.5% aqueous solution of sodium dodecyl diphenylether disulfonic acid (ELEMINOL MON-7, manufactured by Sanyo Chemical Industries, Ltd.) and 90 parts by mass of ethyl acetate were mixed and stirred together to obtain a milky liquid. This was taken as aqueous phase 1.

—Synthesis of Low-Molecular-Mass Polyester—

In a reaction vessel equipped with a condenser tube, a stirrer, and a nitrogen inlet tube, 229 parts by mass of bisphenol A ethylene oxide dimolar adduct, 529 parts by mass of bisphenol A propylene oxide trimolar adduct, 208 parts by mass of terephthalic acid, 46 parts by mass of adipic acid and 2 parts by mass of dibutyl tin oxide were placed, and the reaction was performed under normal pressure at 230° C. for 8 hours, and the reaction was further performed under a reduced pressure of 10 mmHg to 15 mmHg for 5 hours, then 44 parts by mass of anhydrous trimellitic acid was poured into the reaction vessel, and the reaction was performed at 180° C. under normal pressure for 2 hours to obtain a polyester. This polyester was taken as low-molecular mass polyester 1. Low-molecular mass polyester 1 had a glass transition temperature (Tg) of 45° C., a mass average molecular mass of 5,800, a number average molecular mass of 2,600, and an acid value of 24.

—Synthesis of Intermediate Polyester—

In a reaction vessel equipped with a condenser tube, a stirrer, and a nitrogen inlet tube, 682 parts by mass of bisphenol A ethylene oxide dimolar adduct, 81 parts by mass of bisphenol A propylene oxide dimolar adduct, 283 parts by mass of terephthalic acid, 22 parts by mass of anhydrous trimellitic acid and 2 parts by mass of dibutyl tin oxide were placed, and the reaction was performed under normal pressure at 230° C. for 8 hours, and then the reaction was further performed under a reduced pressure of 10 mmHg to 15 mmHg for 5 hours to obtain a polyester. This polyester was taken as intermediate polyester 1.

The obtained intermediate polyester 1 had a number average molecular mass of 2,100, a mass average molecular mass of 9,500, a glass transition temperature (Tg) of 55° C., an acid value of 0.5 and a hydroxyl value of 51.

Next, 410 parts by mass of intermediate polyester 1, 89 parts by mass of isophorone diisocyanate and 500 parts by mass of ethyl acetate were placed in a reaction vessel equipped with a condenser tube, a stirrer, and a nitrogen inlet tube, and the reaction was performed at 100° C. for 5 hours to obtain a reactant. This reactant was taken as prepolymer 1. The percent by mass of free isocyanate of the obtained prepolymer 1 was 1.74%.

—Synthesis of Ketimine—

Into a reaction vessel equipped with a stirrer and a thermometer, 170 parts by mass of isophorone diamine and 75 parts by mass of methyl ethyl ketone were poured, and the reaction was performed at 50° C. for 5 hours to obtain a ketimine compound. This was taken as ketimine compound 1. The amine value of the ketimine compound 1 was 418.

—Preparation of Masterbatch (MB)—

To 1,200 parts by mass of water, 540 parts by mass of carbon black (PBk-7:Printex 60, manufactured by Degsa Co.) [DBP oil absorption=114 mL/100 mg, pH=10] and 1,200 parts by mass of a polyester resin (RS801, manufactured by Sanyo Chemical Industries, Ltd.) were added and mixed in HENSCHEL MIXER (manufactured by MITSUI MINING CO., LTD.), then the mixture was kneaded at 150° C. for 30 minutes using two rollers, extrusion cooled and crushed with a pulverizer to obtain a masterbatch. This was taken as masterbatch 1.

—Preparation of Oil Phase—

Into a vessel equipped with a stirrer and thermometer, 300 parts by mass of low-molecular mass polyester 1, 90 parts by mass of carnauba wax, and 10 parts by mass of rise wax, and 1,000 parts by mass of ethyl acetate were poured, and the temperature was rapidly cooled to 4° C. Next, the reactant was subjected to a dispersion treatment using a bead mill (Ultra Visco Mill, manufactured by AIMEX CO., LTD.)

under the conditions of a liquid feed rate 1 kg/hr, disk circumferential speed of 6 m/s, 0.5 mm zirconia beads filled at 80% by volume, and the dispersion treatment was performed 3 times to thereby obtain a wax dispersion liquid having a volume average particle diameter of 0.6 μm.

Next, 500 parts by mass of masterbatch 1 and 640 parts by mass of 70% ethyl acetate solution of low-molecular polyester 1 were added to the wax dispersion liquid, and mixed for 10 hours, and then subjected to a dispersion treatment using the bead mill 5 times, and ethyl acetate was added to the reactant to thereby obtain oil phase 1 with the solid density adjusted to 50%.

—Preparation of Polymerized Toner—

In a vessel, 73.2 parts by mass of oil phase 1, 6.8 parts by mass of prepolymer 1, and 0.48 parts by mass of ketimine compound 1 were poured, and 120 parts by mass of aqueous phase 1 was added to the sufficiently mixed emulsified oil phase 1 and mixed using Homomixer for 1 minute and then astringed while slowly agitating for 1 hour using a paddle to thereby obtain emulsified slurry 1.

The obtained emulsified slurry 1 was subjected to a solvent removal treatment at 30° C. for 1 hour, and then matured at 60° C. for 5 hours. The matured product was washed, filtrated, dried, and then sieved through a sieve of 75 μm mesh to thereby obtain a toner having a volume average particle diameter of 6.1 μm and a number average particle diameter of 5.4 μm. Then, 100 parts by mass of the toner, 0.7 parts by mass of a hydrophobic silica, and 0.3 parts by mass of a hydrophobized titanium oxide were mixed using HENSCHEL MIXER to thereby obtain toner 3.

Example 1

Preparation of Carrier 1

Using an apparatus shown in FIG. 7, into a coating agent dissolution tank (200 mL inside volume), 200 parts by mass of a silicone resin represented by the following structural formula (solvent remover SR213 manufactured by DOW CORNING TORAY SILICONE CO., LTD.; mass average molecular mass=4,000), and 10 parts by mass of a catalyst $[(CH_3)_2Sn(OCOCH_3)_2]$ were poured, and a valve 3 was opened while agitating the mixture, and a carbon dioxide (manufactured by Ota Oxygen Co.; purity=99.5%) was supplied thereto using a pressurizing pump 1, and the pressure and the temperature were set to 25 MPa and 80° C., and then the valve 3 was closed. To a carrier treatment tank (400 mL inside volume), 500 parts by mass of a ferrite core material having a volume average particle diameter of 50 μm (saturated magnetic moment per 1 k gauss=65 emu/g) were poured, a valve 6 was opened while agitating the mixture, and a carbon dioxide (manufactured by Ota Oxygen Co.; purity=99.5%) was supplied thereto using a pressurizing pump 1, the pressure and the temperature were set to 25 MPa and 80° C., and then the valve 6 was closed.

Next, valves 3, 5, and 7 were opened, and the pressurizing pump 1 and a depressurizing pump 1 were put into action and then while controlling the inner pressure of the carrier treatment tank such that the condition of 25 MPa and 80° C. was maintained, the treatment liquid was circulated in the carrier treatment tank for 1 hour under the condition of normal pressure and a flow rate of 1 L/min to saturate the coating agent in the carrier treatment tank. The valve 3 was closed, and the pressure inside the carrier treatment tank was restored to normal pressure in 2 hours using the depressurizing pump 1. It was possible to collect non-used coating agent from both of the coating agent dissolution tank and a raw material collection tank and to recycle it.

The obtained ferrite core material coated with the silicone resin was heated at 200° C. for 1 hour to thereby obtain carrier 1.

FIG. 14 is one of 10 sheets of scanning electron microscopic photographs of the cross-sectional surfaces of carrier 1. For each of the 10 sheets scanning electron microscopic photographs of the cross-sectional surfaces, eight sites were arbitrarily selected, and the thickness of the coating layer was measured by the following method. As the result, the average thickness of the carrier 1 was 0.3 μm, and the standard deviation was 0.04. FIG. 15 is a partially enlarged photograph of FIG. 14.

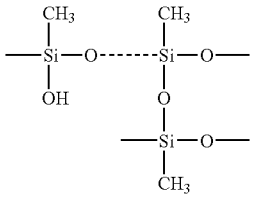

<Measurement of Average Thickness and Standard Deviation of Carrier Coating Layer>

On each of the 10 sheets of scanning electron microscopic photographs, eight radiation lines were drawn in eight directions respectively angled at 45 degrees centering around the median point of each of the carrier cross-sectional surfaces, and the thickness of the coating layer at 80 sites in total measured at eight intersection points with the core material surface was determined, and then the thickness average and the standard deviation were calculated.

Specifically, as shown in FIG. 18, photographs of the cross-sectional surface of the carrier were taken at a magnification of 2,000-times using a scanning electron microscope. From the obtained scanning electron microscopic photographs of cross-sectional surfaces of the carrier, 10 pieces of carrier particles were arbitrarily selected. Then, as shown in FIG. 19, eight radiation lines were drawn on the respective photographs in eight directions respectively angled at 45 degrees centering around the median point of the each cross-sectional surface of the carrier particles, and then the thickness of the coating layer was measured at eight sites on each of the 10 pieces of carrier particles at eight intersection points with the each of the carrier particle surfaces. The average value was taken as the thickness of the coating layer, and the standard deviation of the measure values of the 80 sites was calculated.

Example 2

An apparatus shown in FIG. 8 was used. Into a coating agent dissolution tank (100 mL inside volume), 200 parts by mass of a silicone resin represented by the above-noted structural formula (solvent remover SR213 manufactured by DOW CORNING TORAY SILICONE CO., LTD.; mass average molecular mass=4,000), and 10 parts by mass of a catalyst $[(CH_3)_2Sn(OCOCH_3)_2]$ were poured.

To a carrier treatment tank (125 mL inside volume), 500 parts by mass of a ferrite core material having a volume average particle diameter of 50 μm (saturated magnetic moment per 1 k gauss=65 emu/g) were poured, a valve 3 was opened while agitating the inside of the coating agent dissolution tank, and a carbon dioxide (manufactured by Ota Oxygen Co.; purity=99.5%) was supplied thereto using a pressurizing pump 1, the pressure and the temperature were set to 25 MPa and 60° C., and then the valve 3 was closed.

Next, valves 3, 5, and 7 were opened, and the pressurizing pump 1 and a depressurizing pump 1 were put into action and then while controlling the inner pressure of the carrier treatment tank such that the condition of 25 MPa and 60° C. was maintained, the treatment liquid was circulated in the carrier treatment tank for 1 hour under the condition of normal pressure and a flow rate of 1 L/min to saturate the coating agent in the carrier treatment tank. The valve 3 was closed, and the pressure inside the carrier treatment tank was restored in 2 hours using the depressurizing pump 1. It was possible to collect non-used coating agent from both of the coating agent dissolution tank and a raw material collection tank and to recycle it.

The obtained ferrite core material coated with the silicone resin was heated at 200° C. for 1 hour to thereby obtain carrier 2.

The obtained carrier 2 was measured as to the average thickness and the standard deviation of the coating layer in the same manner as in Example 1. The carrier 2 had a thickness of 0.2 μm and a standard deviation of 0.06.

Example 3

Using an apparatus shown in FIG. 9, into a coating agent dissolution tank (500 mL inside volume), 100 parts by mass of a silicone resin represented by the above-noted structural formula (solvent remover SR213 manufactured by DOW CORNING TORAY SILICONE CO., LTD.; mass average molecular mass=4,000), and 5 parts by mass of a catalyst $[(CH_3)_2Sn(OCOCH_3)_2]$ were poured, a valve 3 was opened, and while supplying a carbon dioxide (manufactured by Ota Oxygen Co.; purity=99.5%) using a pressurizing pump 1 and agitating the inside of the coating agent dissolution tank, a carrier coating solution was prepared under the conditions of 35 MPa and 40° C.

Next, to a carrier treatment tank equipped with a rotatable bottom plate (1,000 mL inside volume), 500 parts by mass of a ferrite core material having a volume average particle diameter of 50 μm (saturated magnetic moment per 1 k gauss=65 emu/g) were poured, a valve 6 was opened, and the pressure and the temperature in the tank were set to 3 MPa and 100° C., and the valve 6 was closed. Thereafter, valves 5 and 7 were opened, and a depressurizing pump 1 was put into action to control the inner pressure of the carrier treatment tank such that the inner pressure of the carrier treatment tank was not increased to 7 MPa or more, and the ferrite core material was coated with the carrier coating solution in 40 minutes while agitating the inside of the tank. It was possible to collect non-used coating agent from both of the coating agent dissolution tank and a raw material collection tank and to recycle it.

The obtained ferrite core material coated with the silicone resin was heated at 200° C. for 1 hour to thereby obtain carrier 3.

The obtained carrier 3 was measured as to the average thickness and the standard deviation of the coating layer in the same manner as in Example 1. The carrier 3 had a thickness of 0.4 μm and a standard deviation of 0.07.

Example 4

Synthesis of Carrier 4

An apparatus shown in FIG. 10 was used. Into a coating solution dissolution tank (500 mL inside volume), 50 parts by mass of a silicone resin represented by the above-noted structural formula (solvent remover SR213 manufactured by DOW CORNING TORAY SILICONE CO., LTD.; mass average molecular mass=4,000), and 2.5 parts by mass of a catalyst $[(CH_3)_2Sn(OCOCH_3)_2]$ were poured. Into a carrier treatment tank (1,000 mL inside volume), 500 parts by mass of a ferrite core material (saturated magnetic moment per 1 k gauss=65 emu/g) were poured, valves 3 and 5 were opened, a carbon dioxide (manufactured by Ota Oxygen Co.; purity=99.5%) was supplied thereto using a pressurizing pump 1, and while agitating the inside of the tank, a ferrite dispersion liquid was prepared under the conditions of 15 MPa and 80° C.

The obtained ferrite dispersion liquid was sprayed (rapidly expanded) from a nozzle of a spray tank which was set in an atmosphere of normal pressure and 30° C. It was possible to collect non-used coating agent from both of the coating agent dissolution tank and a raw material collection tank and to recycle it.

The obtained ferrite core material coated with the silicone resin was heated at 200° C. for 1 hour to thereby obtain carrier 4.

The obtained carrier 4 was measured as to the average thickness and the standard deviation of the coating layer in the same manner as in Example 1. The carrier 4 had a thickness of 0.4 μm and a standard deviation of 0.07.

Example 5

Synthesis of Carrier 5

Carrier 5 was prepared in the same manner as in Example 1 except that the carrier coating agent was changed to an epoxy-modified silicone resin (SR2115 manufactured by TORAY DOW CORNING CO., LTD.), the pressure in the treatment was changed to 30 MPa, and the temperature was changed to 100° C.

The obtained carrier 5 was measured in the same manner as in Example 1, and the carrier 5 had an average coating layer thickness of 0.5 μm and a standard deviation of 0.06.

Example 6

Synthesis of Carrier 6

Carrier 6 was prepared in the same manner as in Example 1 except that the carrier coating agent was changed to a silicone resin (KR271 manufactured by Shin-Etsu Chemical Co., Ltd.), the pressure in the treatment was changed to 35 MPa, and the temperature was changed to 100° C.

The obtained carrier 6 was measured in the same manner as in Example 1, and the carrier 6 had an average coating layer thickness of 0.7 μm and a standard deviation of 0.08.

Example 7

Synthesis of Carrier 7

Carrier 7 was prepared in the same manner as in Example 1 except that an aminosilane coupling agent $[NH_2(CH_2)_3Si(OCH_3)_3]$ was further added in an amount of 2.5 parts by mass.

The obtained carrier 7 was measured in the same manner as in Example 1, and the carrier 7 had an average coating layer thickness of 0.5 μm and a standard deviation of 0.08.

Example 8

Synthesis of Carrier 8

Carrier 8 was prepared in the same manner as in Example 4 except that the carrier coating agent was changed to a silicone resin (217 Flake Resin manufactured by TORAY DOW CORNING CO., LTD.), 0.5% by mass (around 5 g/L for the inside volume of tank) of ethanol was added as an entrainer using a pressurizing pump 2, and the ferrite dispersion liquid was prepared under the conditions of 30 MPa and 80° C. and sprayed at an atmosphere of 50° C. The obtained carrier 8 was measured in the same manner as in Example 1, and the carrier 8 had an average coating layer thickness of 0.2 μm and a standard deviation of 0.03.

—Synthesis of Carrier 9—

Carrier 9 was prepared in the same manner as in Example 8 except that the carrier coating agent was changed to a silicone resin (220 Flake Resin manufactured by TORAY DOW CORNING CO., LTD.), and 5% by mass methanol was added as an entrainer.

The obtained carrier 9 was measured in the same manner as in Example 1, and the carrier 9 had an average coating layer thickness of 0.3 μm and a standard deviation of 0.04.

Example 10

Synthesis of Carrier 10

Carrier 10 was prepared in the same manner as in Example 8 except that the carrier coating agent was changed to a silicone resin (249 Flake Resin manufactured by TORAY DOW CORNING CO., LTD.), and 1% by mass propanol was added as an entrainer.

The obtained carrier 10 was measured in the same manner as in Example 1, and the carrier 10 had an average coating layer thickness of 0.4 μm and a standard deviation of 0.04.

Example 11

Synthesis of Carrier 11

Carrier 11 was prepared in the same manner as in Example 2 except that a ferrite core material having a volume average particle diameter of 35 μm was used.

Figure 11:
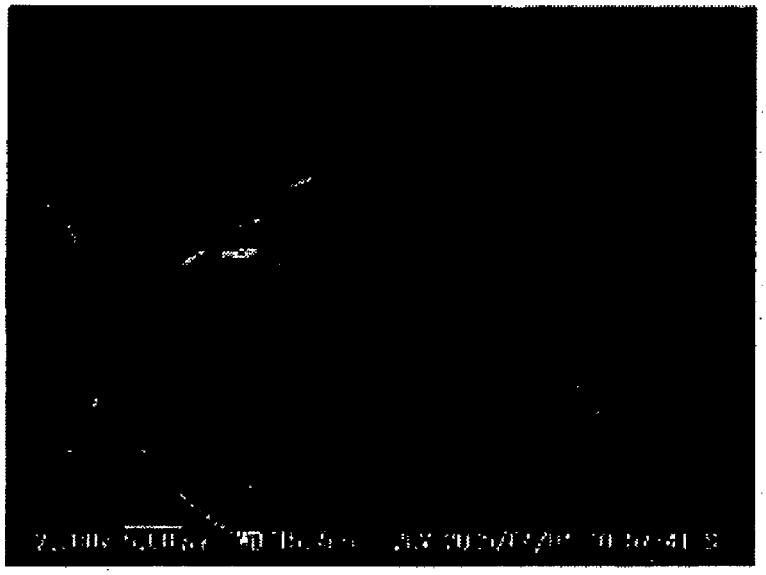
FIG. 11 is a scanning electron microscopic photograph of a ferrite core material having a volume average particle diameter of 35 μm of Example 11.
Figure 12:
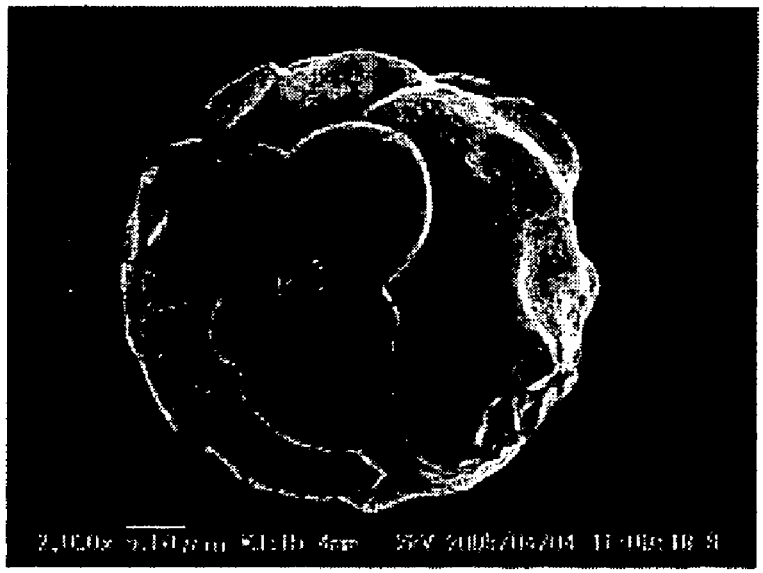
FIG. 12 is a scanning electron microscopic photograph of carrier 11 prepared in Example 11.

FIG. 11 is a scanning electron microscopic photograph of the ferrite core material having a volume average particle diameter of 35 μm. FIG. 12 is a scanning electron microscopic photograph of the carrier 11.

The obtained carrier 11 was measured in the same manner as in Example 1, and the carrier 11 had an average coating layer thickness of 0.2 μm and a standard deviation of 0.02.

Example 12

Synthesis of Carrier 12

Carrier 12 was prepared in the same manner as in Example 1 except that the carrier coating agent was changed to a silicone resin (249 Flake Resin manufactured by TORAY DOW CORNING CO., LTD.), the inner pressure of the carrier treatment tank was changed to 30 MPa and restored to normal pressure in 10 minutes using a depressurizing pump 1.

The obtained carrier 12 was measured in the same manner as in Example 1, and the carrier 12 had an average coating layer thickness of 0.3 μm and a standard deviation of 0.03.

Example 13

Synthesis of Carrier 13

Carrier 13 was prepared in the same manner as in Example 12 except that the inner pressure of the carrier treatment tank was restored to normal pressure in 1 hour using a depressurizing pump 1.

The obtained carrier 13 was measured in the same manner as in Example 1, and the carrier 13 had an average coating layer thickness of 0.2 μm and a standard deviation of 0.03.

Comparative Example 1

Preparation of Comparative Carrier 1

Relative to 5 kg of a ferrite core material (saturated magnetic moment per 1 k gauss) having a volume average particle diameter of 35 μm, 5 g of a dispersion liquid containing 1,000 g of a toluene solution (solid density: 10% by mass) of a silicone resin (mass average molecular mass=4,000), and 5 g of a catalyst $[(CH_3)_2Sn(OCOCH_3)_2]$ were used and mixed. Using a rotatable bottom plate coating device, the ferrite core material was coated with the carrier coating solution in an atmosphere of 100° C. at a coating rate of around 50 g/m for 20 minutes, and then the obtained ferrite particles coated with the silicone resin was heated at 200° C. for 1 hour to thereby prepare comparative carrier 1.

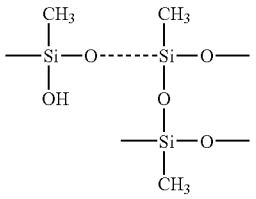

Figure 13:
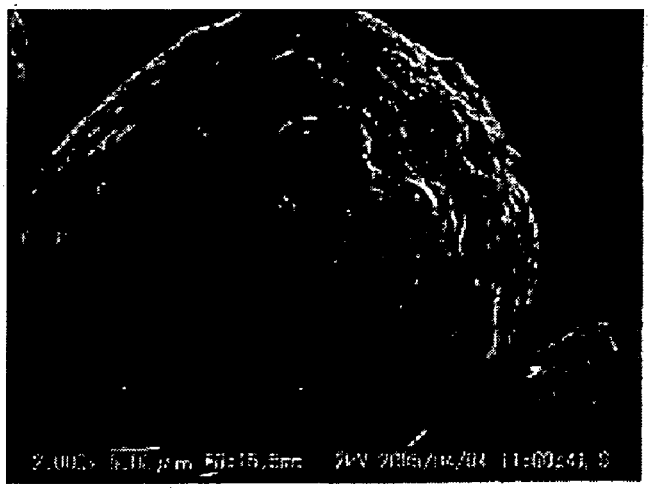
FIG. 13 is a scanning electron microscopic photograph of comparative carrier 1 prepared in Comparative Example 1.

FIG. 13 is a scanning electron microscopic photograph of comparative carrier 1. FIG. 16 is a scanning electron microscopic photograph of the carrier surface of comparative carrier 1. FIG. 17 is a partially enlarged photograph of FIG. 16.

It was found that carrier 11 shown in FIGS. 14 and 15 had a uniform coating layer thickness and excellent adhesiveness because there were no exfoliated sites and holes in the coating layer, compared to comparative carrier 1 shown in FIGS. 16 and 17.

The obtained comparative carrier 1 was measured in the same manner as in Example 1, and the comparative carrier 11 had an average coating layer thickness of 3.0 μm and a standard deviation of 1.55.

Comparative Example 2

Preparation of Comparative Carrier 2

Comparative Carrier 2 was prepared in the same manner as in Comparative Example 1 except that the volume average particle diameter of ferrite material was changed to 50 μm.

The obtained comparative carrier 2 was measured in the same manner as in Example 1, and the comparative carrier 2 had an average coating layer thickness of 1.5 μm and a standard deviation of 0.63.

<Measurement of Silanol Concentration>

The silanol concentration used in the respective coating solutions of Examples 1 to 13 was measured by the Karl-Fischer titration method described in the Japanese Industrial Standards (JIS) K0068 "Moisture Measuring Method of Chemical Product". The amount of sample and the preparation of a titration solvent were conformed to the titration method.

Specifically, (1) a methanol-chloroform mixture solvent was used, and the total amount of SiOH and $H_2O$ was measured. (2) next, pyridine-ethylene glycol mixture solution was used, and the amount of $H_2O$ was measured. (3) then, the silanol concentration was determined by deducting the measured value (2) from the measured value (1). Table 1 shows the results.

TABLE 1

| | Silicone resin | Property under conditions of room temperature and normal pressures | Silanol concentration (% by mass) |
|---|---|---|---|
| Examples. 1-4, 7, and 11 | SR213 | liquid | 40 |
| Ex. 5 | SR2115 | liquid | 37 |
| Ex. 6 | KR271 | liquid | 25 |
| Ex. 8 | 217 FLAKE RESIN | solid | 7 |
| Ex. 9 | 220 FLAKE RESIN | solid | 1 |
| Examples 10, 12, and 13 | 249 FLAKE RESIN | solid | 9 |

Examples 14 to 34 and Comparative Examples 3 to 6

Each of the prepared carriers 1 to 13 and comparative carriers 1 and 2 was combined with each of the toners 1 to 3 as shown in the following Table 2 to thereby prepare respective developers of Examples 14 to 34 and Comparative Examples 3 to 6 in the usual manner.

Next, using the obtained respective developers, a solid image with an amount of each developer adhesion of 1.00±0.05 mg/cm$^2$ was printed on copy sheets of paper (TYPE6000 <70W> manufactured by Ricoh Company Ltd., using a tandem color electrophotographic system (imagio Neo 450 manufactured by Ricoh Company Ltd.). The solid image was repeatedly printed on 100,000 copy sheets of paper. The image density of the obtained solid image was visually checked as to the early stage of the running output and after the duration test of 100,000 sheets and then evaluated based on the following criteria. The higher the obtained image density, the image having higher image density can be formed. This evaluation is common in those used in examples of the developer container, the process cartridge, the image forming apparatus, and the image forming method of the present invention. Table 2 shows the evaluation results.

[Evaluation Criteria]

A: There was no variation in image density in the early stage of the running output and after the duration test of 100,000 sheets, and it was possible to obtain a high-quality image.

B: After the duration test of 100,000 sheets, the image density was slightly lowered, and the image quality was degraded.

C: After the duration test of 100,000 sheets, the image density was significantly lowered, and the image quality was greatly degraded.

<Toner Scattering>

The level of toner pollution in the electrographic system after the running output of 100,000 sheets of a 5% image-area ratio chart was visually checked and evaluated as 4 levels based on the following criteria. Table 2 shows the evaluation results.

[Evaluation Criteria]

A: No toner pollution was found in the electrophotographic system, and the system remained in an excellent state.

B: Toner pollution was not observed in the electrophotographic system, and the system remained in a favorable state.

C: Although toner pollution was observed in the electrophotographic system, the system was on a practically used level.

D: Toner pollution was conspicuous in the electrophotographic system, the system was not on a practically used level.

<Background Smear>

The level of background smear of the image background portions after the running output of 100,000 sheets of a 5% image-area ratio chart was visually checked and evaluated based on the following criteria. Table 2 shows the evaluation results.

[Evaluation Criteria]

A: There was no background smear in the image background portions.

B: A slight amount of background smear observed in the image background portions.

C: Background smear was observed in the image background portions.

<Charge Amount>

The respective developers were weighed in an amount of 6 g and put into a closable metal cylinder and stirred using a blower to thereby determine the charge amount. The toner content was adjusted to 4.5% by mass to 5.5% by mass. Table 2 shows the evaluation results.

<Overall Evaluation>

From the above-noted evaluation results, the respective developers were evaluated based on the following criteria. Table 2 shows the evaluation results.

[Evaluation Criteria]

A: Excellent

B: Poor

TABLE 2

| | Carrier | Toner | Image density | Toner scattering | Background smear | Charge amount (μC/g) | Overall Evaluation |
|---|---|---|---|---|---|---|---|
| Ex. 14 | Carrier 1 | Toner 3 | B | A | A | −35 | A |
| Ex. 15 | Carrier 1 | Toner 2 | B | A | A | −35 | A |
| Ex. 16 | Carrier 1 | Toner 1 | B | A | A | −37 | A |
| Ex. 17 | Carrier 2 | Toner 3 | B | A | A | −35 | A |

TABLE 2-continued

| | Carrier | Toner | Image density | Toner scattering | Background smear | Charge amount (μC/g) | Overall Evaluation |
|---|---|---|---|---|---|---|---|
| Ex. 18 | Carrier 3 | Toner 3 | B | B | A | −30 | A |
| Ex. 19 | Carrier 4 | Toner 3 | B | B | A | −29 | A |
| Ex. 20 | Carrier 5 | Toner 2 | B | B | A | −28 | A |
| Ex. 21 | Carrier 6 | Toner 1 | B | B | A | −28 | A |
| Ex. 22 | Carrier 7 | Toner 1 | B | B | A | −32 | A |
| Ex. 23 | Carrier 8 | Toner 3 | B | B | A | −31 | A |
| Ex. 24 | Carrier 9 | Toner 3 | B | B | A | −32 | A |
| Ex. 25 | Carrier 10 | Toner 3 | B | B | A | −30 | A |
| Ex. 26 | Carrier 11 | Toner 3 | B | A | A | −35 | A |
| Ex. 27 | Carrier 11 | Toner 2 | B | A | A | −38 | A |
| Ex. 28 | Carrier 11 | Toner 1 | B | A | A | −37 | A |
| Ex. 29 | Carrier 12 | Toner 3 | A | A | A | −38 | A |
| Ex. 30 | Carrier 12 | Toner 2 | A | A | A | −40 | A |
| Ex. 31 | Carrier 12 | Toner 1 | A | A | A | −37 | A |
| Ex. 32 | Carrier 13 | Toner 3 | B | A | A | −38 | A |
| Ex. 33 | Carrier 13 | Toner 2 | B | A | A | −37 | A |
| Ex. 34 | Carrier 13 | Toner 1 | B | A | A | −35 | A |
| Compara. Ex. 3 | Comparative carrier 1 | Toner 3 | C | D | C | −13 | B |
| Compara. Ex. 4 | Comparative carrier 2 | Toner 3 | C | D | C | −15 | B |
| Compara. Ex. 5 | Comparative carrier 2 | Toner 2 | C | D | C | −18 | B |
| Compara. Ex. 6 | Comparative carrier 2 | Toner 1 | C | C | C | −18 | B |

From the results shown in Table 2, it was confirmed that the developers of Examples 14 to 34 respectively using carriers 1 to 13 which had been treated with a supercritical fluid were more excellent in charge ability than developers of Comparative Examples 3 to 6, and the developers of Examples 14 to 34 respectively allow obtaining high-image density without substantially causing toner scattering and background smear.

The method for producing a carrier of the present invention enables efficiently producing a carrier which is preferably used for xerography, electrostatic recording method, electrostatic printing method, etc. because the method for producing a carrier of the present invention allows obtaining a dry carrier without substantially causing waste fluid by restoring the pressure to normal pressure in the treatment and allows achieving low-cost performance, low-environmental burden, energy saving, and natural resource saving.

The carrier of the present invention can be preferably used for developers, developer containers, process cartridges, image forming apparatuses, image forming methods, and the like because the carrier excels in toner charge ability, temporal stability, etc., has a coating layer having excellent adhesiveness and uniform thickness, and has high-mechanical strength

What is claimed is:

1. A method for producing a carrier comprising:

forming a coating layer on a surface of a core material by dissolving or dispersing at least a coating resin in a supercritical or subcritical fluid.

2. The method for producing a carrier according to claim 1, wherein the supercritical or subcritical fluid comprises at least a carbon dioxide.

3. The method for producing a carrier according to claim 1, wherein the supercritical or subcritical fluid comprises an entrainer.

4. The method for producing a carrier according to claim 3, wherein the content of the entrainer is 0.1% by mass to 10% by mass.

5. The method for producing a carrier according to claim 3, wherein the entrainer has poor solubility relative to the core material and the coating resin under the conditions of room temperature and normal pressure.

6. The method for producing a carrier according to claim 3, wherein the entrainer is a lower alcohol selected from methanols, ethanols, and propanols.

7. The method for producing a carrier according to claim 1, wherein the coating resin is a silicone resin represented by the following structural formula:

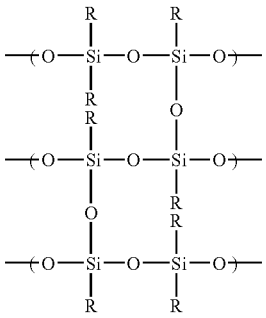

wherein R represents a hydrogen atom, a hydroxyl group, an alkoxy group, an alkyl group, or an aryl group.

8. The method for producing a carrier according to claim 7, wherein the silicone resin is solid under the conditions of room temperature and normal pressure.

9. The method for producing a carrier according to claim 7, wherein the silanol concentration of the silicone resin is 1% by mass to 40% by mass.

10. The method for producing a carrier according to claim 7, wherein the mass average molecular mass of the silicone resin is 500 to 100,000.

11. The method for producing a carrier according to claim 1, wherein the volume average particle diameter of the core material is 20 μm to 50 μm.

* * * * *